US009613576B2

(12) United States Patent
Yoshizawa

(10) Patent No.: US 9,613,576 B2
(45) Date of Patent: Apr. 4, 2017

(54) IMAGE DISPLAY DEVICE AND CONTROL METHOD OF IMAGE DISPLAY DEVICE

(71) Applicant: SEIKO EPSON CORPORATION, Tokyo (JP)

(72) Inventor: Koichi Yoshizawa, Shimosuwa-machi (JP)

(73) Assignee: SEIKO EPSON CORPORATION, Tokyo (JP)

( * ) Notice: Subject to any disclaimer, the term of this patent is extended or adjusted under 35 U.S.C. 154(b) by 49 days.

(21) Appl. No.: 14/575,342

(22) Filed: Dec. 18, 2014

(65) Prior Publication Data

US 2015/0187242 A1 Jul. 2, 2015

(30) Foreign Application Priority Data

Dec. 26, 2013 (JP) ..... 2013-268717

(51) Int. Cl.
*G09G 3/36* (2006.01)

(52) U.S. Cl.
CPC ... *G09G 3/3611* (2013.01); *G09G 2320/0646* (2013.01); *G09G 2320/0693* (2013.01); *G09G 2360/145* (2013.01); *G09G 2360/16* (2013.01)

(58) Field of Classification Search
None
See application file for complete search history.

(56) References Cited

U.S. PATENT DOCUMENTS

2006/0007409 A1* 1/2006 Sato ..... G03B 21/13 353/97
2006/0215130 A1* 9/2006 Nakamura ..... G03B 9/02 353/97

FOREIGN PATENT DOCUMENTS

JP A-2004-523001 7/2004
WO WO 02/069030 A2 9/2002

* cited by examiner

*Primary Examiner* — Nicholas Lee
*Assistant Examiner* — Duane N Taylor, Jr.
(74) *Attorney, Agent, or Firm* — Oliff PLC

(57) ABSTRACT

An image display device includes a first light modulation device including a plurality of display pixels, a lighting unit including a plurality of light adjusting elements, an illumination distribution storage unit that stores an illumination range information, a light adjusting information determination unit that determines light adjusting information for controlling the light adjusting elements of the lighting unit, and a shift information acquisition unit that acquires information of a position shift between the first light modulation device and the lighting unit. The light adjusting information determination unit modifies the illumination range based on the position shift information acquired by the shift information acquisition unit, and determines the light adjusting information based on the feature quantity of the first image information corresponding to display pixels in the modified illumination range.

9 Claims, 11 Drawing Sheets

SA S

| | | | | | | | | | | | |
|---|---|---|---|---|---|---|---|---|---|---|---|
| 0 | 0 | 0 | 0 | 0 | 0 | 0 | 0 | 0 | 0 | 0 | 0 |
| 0 | 0 | 0 | 0 | 0 | 0.01 | 0.01 | 0 | 0 | 0 | 0 | 0 |
| 0 | 0 | 0.01 | 0.02 | 0.05 | 0.07 | 0.07 | 0.05 | 0.02 | 0.01 | 0 | 0 |
| 0 | 0 | 0.02 | 0.10 | 0.21 | 0.29 | 0.29 | 0.21 | 0.10 | 0.02 | 0 | 0 |
| 0 | 0 | 0.05 | 0.21 | 0.47 | 0.63 | 0.63 | 0.47 | 0.21 | 0.05 | 0 | 0 |
| 0 | 0.01 | 0.07 | 0.29 | 0.63 | 0.85 | 0.85 | 0.63 | 0.29 | 0.07 | 0.01 | 0 |
| 0 | 0.01 | 0.07 | 0.29 | 0.63 | 0.85 | 0.85 | 0.63 | 0.29 | 0.07 | 0.01 | 0 |
| 0 | 0 | 0.05 | 0.21 | 0.47 | 0.63 | 0.63 | 0.47 | 0.21 | 0.05 | 0 | 0 |
| 0 | 0 | 0.02 | 0.10 | 0.21 | 0.29 | 0.29 | 0.21 | 0.10 | 0.02 | 0 | 0 |
| 0 | 0 | 0.01 | 0.02 | 0.05 | 0.07 | 0.07 | 0.05 | 0.02 | 0.01 | 0 | 0 |
| 0 | 0 | 0 | 0 | 0 | 0.01 | 0.01 | 0 | 0 | 0 | 0 | 0 |
| 0 | 0 | 0 | 0 | 0 | 0 | 0 | 0 | 0 | 0 | 0 | 0 |

FIG. 7

IMAGE DISPLAY DEVICE AND CONTROL METHOD OF IMAGE DISPLAY DEVICE

The entire disclosure of Japanese Patent Application No. 2013-268717, filed Dec. 26, 2013, is expressly incorporated by reference herein.

BACKGROUND

1. Technical Field

The present invention relates to an image display device and a control method of an image display device.

2. Related Art

In the related art, a display device is known that includes a light source, a display screen including first and second spatial light modulators provided so as to modulate light from the light source, and an optical system configured so as to project light modulated by the first spatial light modulator onto the first surface of the display screen (for example, JP-T-2004-523001). In such a display device, it is possible to display a high-contrast image over a wide dynamic range.

However, in the display device disclosed in JP-T-2004-523001, even if the first and second light modulators are made to correspond to each other during light adjustment, the influence of illumination on pixels around the associated pixels occurs. That is, since pixels around the second spatial light modulator are also illuminated due to the spread of illumination light emitted from the first spatial light modulator, a desired image may not be able to be output. For example, the brightness of image light emitted from the second spatial light modulator may be reduced. Therefore, control considering the spread of illumination light from the first spatial light modulator is required. In addition, when using the two spatial light modulators in this manner, a shift from the design value may occur in the positional relationship between the two spatial light modulators due to assembling accuracy, mounting position change overtime, position change due to heat, or the like. When a shift occurs in the positional relationship between the two spatial light modulators, the illumination value on the second spatial light modulator changes from the intended value. For this reason, there is a problem in that the gradation cannot be expressed as intended. Hereinafter, the "spatial light modulator" is referred to as a "light modulation device".

SUMMARY

An advantage of some aspects of the invention is to solve at least a part of the problems described above, and the invention can be implemented as the following forms or application examples.

APPLICATION EXAMPLE 1

This application example is provided an image display device including: a first light modulation device that includes a plurality of display pixels and modulates light based on first image information; a lighting unit that includes a plurality of light adjusting elements and emits adjusted light to the first light modulation device; an illumination distribution storage unit that stores an illumination range information, the illumination range information represents an illumination range when light emitted from the light adjusting elements illuminates the display pixels of the first light modulation device; a light adjusting information determination unit that determines light adjusting information for controlling the light adjusting elements of the lighting unit based on a feature quantity of the first image information corresponding to the display pixels in the illumination range; and a shift information acquisition unit that acquires information of a position shift between the first light modulation device and the lighting unit. The light adjusting information determination unit modifies the illumination range based on the position shift information acquired by the shift information acquisition unit, and determines the light adjusting information based on a feature quantity of the first image information corresponding to display pixels in the modified illumination range.

The image display device described above includes the first light modulation device including display pixels and the lighting unit including light adjusting elements. The shift information acquisition unit acquires the information of a position shift between the first light modulation device and the lighting unit. The light adjusting information determination unit modifies the illumination range when light emitted from each light adjusting element of the lighting unit illuminates the display pixels of the first light modulation device based on the position shift information, and determines the light adjusting information for controlling the light adjusting elements of the lighting unit based on the feature quantity of the first image information in the modified illumination range. Therefore, the lighting unit can perform light adjustment in consideration of the feature quantity of the first pixel information corresponding to the illumination range modified according to the position shift.

APPLICATION EXAMPLE 2

This application example is directed to the image display device according to the application example described above, wherein the illumination distribution storage unit further stores distribution information of an illumination intensity when light emitted from the light adjusting elements illuminates the display pixels of the first light modulation device, and the image display device further includes an illumination value calculation unit, which calculates an illumination value of light reaching each of the display pixels of the first light modulation device based on the light adjusting information of the lighting unit, the distribution information of the illumination intensity, and the position shift information, and an image information generation unit, which generates second image information to be set in the first light modulation device based on the first image information and the illumination value of the light reaching each of the display pixels calculated by the illumination value calculation unit.

According to the image display device described above, the illumination value calculation unit calculates the illumination value of light reaching each display pixel of the first light modulation device based on the light adjusting information, the distribution information of the illumination intensity, and the position shift information. The image information generation unit generates the second image information to be set in the first light modulation device based on the illumination value and the first image information. Therefore, it is possible to generate the second image information to be set in the first light modulation device in consideration of the position shift information and the illumination light from the lighting unit. That is, it is possible to generate the pixel information (pixel value) to be set in the display pixels.

APPLICATION EXAMPLE 3

This application example is directed to the image display device according to the application example described above, wherein in the image information generation unit, a value obtained by dividing a pixel value of the first image information by the illumination value is set as a pixel value of the second image information.

According to the image display device described above, the value obtained by dividing the first image information by the illumination value is set as the second image information. Therefore, also in the second image information, it is possible to maintain the brightness of the first image information almost equally while taking into consideration the brightness control by the light adjustment of the lighting unit.

APPLICATION EXAMPLE 4

This application example is directed to the image display device according to the application example described above, wherein in the light adjusting information determination unit, the feature quantity of the first image information is set to a maximum value of a pixel value of the first image information in an illumination range obtained by modifying the illumination range based on the position shift information.

According to the image display device described above, the feature quantity of the first image information is set to the maximum value of the pixel value of the first image information in the modified illumination range. Therefore, since it is possible to suppress a reduction in the brightness of the illumination value with which the display pixel of the first light modulation device is illuminated, it is possible to perform light adjustment control that can almost reproduce the brightness of the input first image information.

APPLICATION EXAMPLE 5

This application example is directed to the image display device according to the application example described above, which further includes an operation receiving unit that receives an operation input for the image display device, wherein the operation receiving unit receives an input of the position shift information, and the shift information acquisition unit acquires the position shift information input by the operation receiving unit.

According to the image display device described above, the operation receiving unit receives an input of position shift information. The shift information acquisition unit acquires the position shift information from the operation receiving unit. Accordingly, a user can input the position shift information.

APPLICATION EXAMPLE 6

This application example is directed to the image display device according to the application example described above, which further includes: an imaging unit that generates captured image data by imaging a range including an image displayed by the image display device; and a detection unit that detects the position shift information based on the captured image data that has been captured by the imaging unit, wherein the shift information acquisition unit acquires the position shift information from the detection unit.

According to the image display device described above, the detection unit detects the position shift information based on the captured image data that has been captured by the imaging unit. The shift information acquisition unit acquires the position shift information from the detection unit. Therefore, the image display device can acquire the position shift information using the imaging unit.

APPLICATION EXAMPLE 7

This application example is directed to the image display device according to the application example described above, wherein the detection unit includes: a calibration unit that associates a positional relationship between the captured image data and a display image; a center-of-gravity specification unit that specifies a position corresponding to a center of gravity of each light adjusting element in the display image by sequentially turning on the light adjusting elements of the lighting unit; and a position shift calculation unit that calculates the position shift information based on the center of gravity of each light adjusting element calculated by the center-of-gravity specification unit.

According to the image display device described above, the detection unit includes the calibration unit, the center-of-gravity specification unit, and the position shift calculation unit. Therefore, the image display device can acquire the position shift information using the imaging unit.

APPLICATION EXAMPLE 8

This application example is directed to a control method of an image display device including a first light modulation device that includes a plurality of display pixels and modulates light based on first image information, a lighting unit that includes a plurality of light adjusting elements and emits adjusted light to the first light modulation device, and an illumination distribution storage unit that stores an illumination range information, the illumination range information represents an illumination range when light emitted from the light adjusting elements illuminates the display pixels of the first light modulation device. The control method includes: determining light adjusting information for controlling the light adjusting elements of the lighting unit based on a feature quantity of the first image information corresponding to the display pixels in the illumination range; and acquiring information of a position shift between the first light modulation device and the lighting unit. In the determination of the light adjusting information, the illumination range is modified based on the position shift information acquired in the acquisition of the position shift information, and the light adjusting information is determined based on a feature quantity of the first image information corresponding to display pixels in the modified illumination range.

According to control method of an image display device, the lighting unit can perform light adjustment in consideration of the feature quantity of the first pixel information corresponding to the illumination range modified according to the position shift.

APPLICATION EXAMPLE 9

This application example is directed to the control method of an image display device according to the application example described above, wherein the illumination distribution storage unit further stores distribution information of an illumination intensity when light emitted from the light adjusting elements illuminates the display pixels of the first light modulation device, and the control method further includes calculating an illumination value of light reaching each of the display pixels of the first light modulation device based on the light adjusting information of the lighting unit, the distribution information of the illumination intensity, and the position shift information, and generating second image information to be set in the first light modulation device based on the first image information and the illumination value of the light reaching each of the display pixels calculated in the calculation of the illumination value.

According to the control method of an image display device described above, it is possible to generate the second image information to be set in the first light modulation device in consideration of the position shift information and the illumination light from the lighting unit. That is, it is possible to generate the pixel information (pixel value) to be set in the display pixels.

In addition, when the image display device and the control method of an image display device described above are implemented using a computer provided in the image display device, the above-described forms and application examples can also be configured in a form, such as a program for realizing the function or a recording medium on which the program is recorded in a computer-readable manner. Various kinds of computer-readable media, such as a flexible disk, a hard disk drive (HDD), a compact disk read only memory (CD-ROM), a digital versatile disk (DVD), a Blu-ray (registered trademark) disc, a magneto-optic disc, a nonvolatile memory card, an internal storage device (a semiconductor memory, such as a random access memory (RAM) or a read only memory (ROM)) of an image display device, and an external storage device (for example, a universal serial bus (USB) memory), can be used as recording media.

BRIEF DESCRIPTION OF THE DRAWINGS

The invention will be described with reference to the accompanying drawings, wherein like numbers reference like elements.

FIG. 6A is a front view of the liquid crystal light valve for adjusting light, and FIG. 6B is a front view of the liquid crystal light valve for display.

FIG. 7 is an explanatory view of the intensity distribution in the illumination range of the liquid crystal light valve for display.

DESCRIPTION OF EXEMPLARY EMBODIMENTS

First Embodiment

Hereinafter, as a first embodiment of an image display device, a projector that displays an image by modulating light emitted from a light source based on image information (image signal) and projecting the modulated light onto an external screen or the like will be described with reference to the accompanying diagrams. In the present embodiment, it is assumed that the position shift information of two light modulation devices is manually input.

Figure 1:
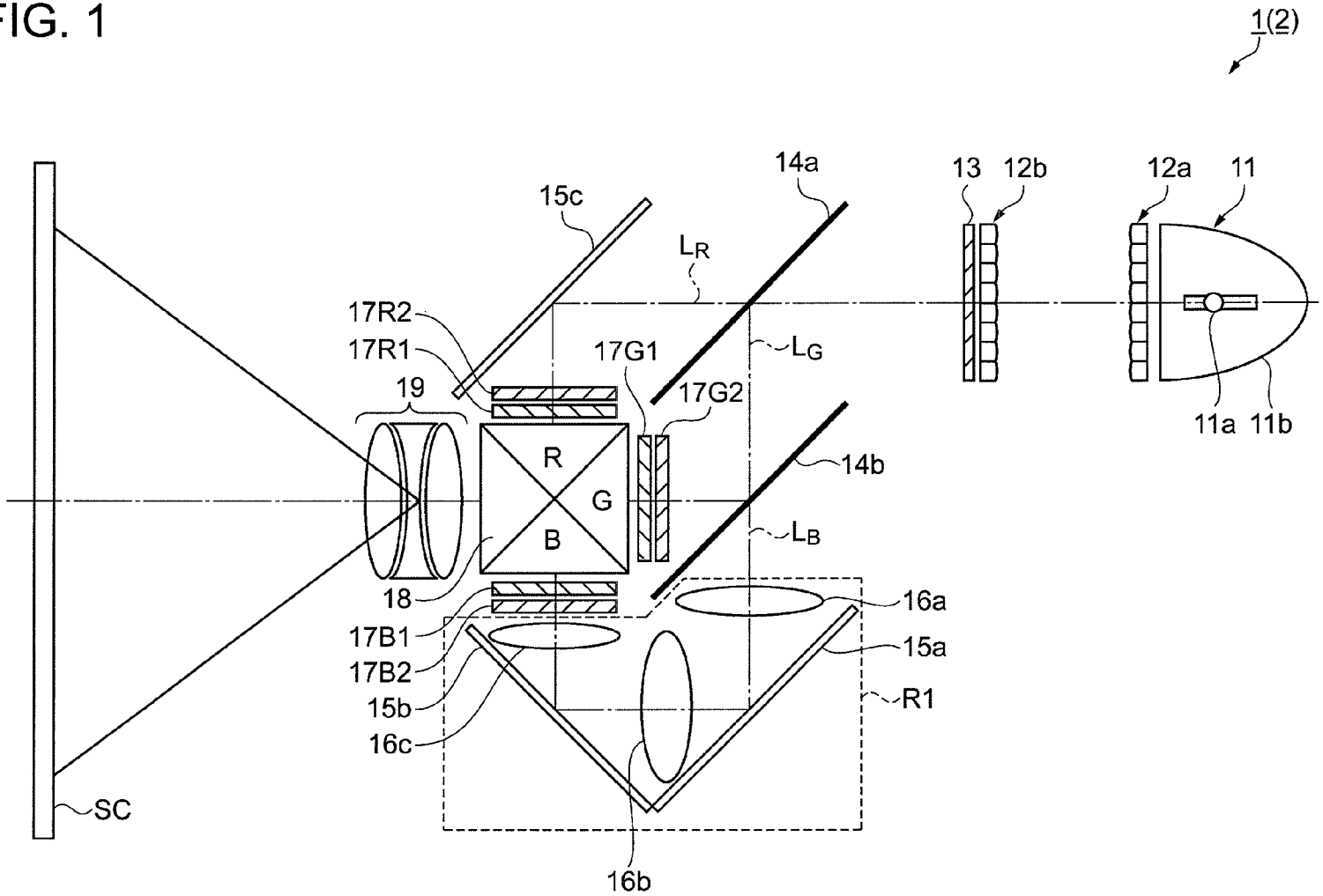
FIG. 1 is a diagram showing the schematic configuration of an optical unit of a projector according to a first embodiment.

FIG. 1 is a diagram showing the schematic configuration of an optical unit of a projector according to a first embodiment. As shown in FIG. 1, a projector 1 includes a light source device 11, fly-eye lenses (uniform illumination unit) 12*a* and 12*b*, a polarization conversion device 13, dichroic mirrors (color separation unit) 14*a* and 14*b*, reflecting mirrors 15*a*, 15*b*, and 15*c*, liquid crystal light valves for adjusting light 17R2, 17G2, and 17B2 as a second light modulation device, liquid crystal light valves for display 17R1, 17G1, and 17B1 as a first light modulation device, a cross dichroic prism 18, and a projection lens (projection unit) 19.

An illumination optical system in the present embodiment is configured to include the light source device 11, the fly-eye lenses 12*a* and 12*b* , and the polarization conversion device 13. The light source device 11 is configured to include a light source lamp 11*a*, such as a high-pressure mercury lamp, and a reflector 11*b* that reflects light from the light source lamp 11*a*. In addition, as a uniform illumination unit that makes the illumination distribution of light from the light source uniform in the liquid crystal light valves 17R, 17G, and 17B that are illuminated regions, the first and second fly-eye lenses 12*a* and 12*b* are provided sequentially from the light source device 11 side. Each of the fly-eye lenses 12*a* and 12*b* is configured to include a plurality of lenses, and functions as a uniform illumination unit that makes the illumination distribution of light emitted from the light source device 11 uniform in the liquid crystal light valves that are illuminated regions. Light from the light source device 11 is emitted from the uniform illumination unit to the polarization conversion device 13.

The polarization conversion device 13 is configured to include a polarizing beam splitter array (PBS array) provided on the uniform illumination unit side and a half-wavelength plate array provided on the dichroic mirror 14*a* side. The polarization conversion device 13 is provided between the uniform illumination unit and the dichroic mirror 14*a*.

Hereinafter, the configuration subsequent to the light source device 11 will be described together with the operation of each component. The dichroic mirror 14*a* that reflects blue and green light components causes red light LR, among light components emitted from the light source device 11, to be transmitted therethrough and blue light LB and green light LG to be reflected therefrom. The red light LR transmitted through the dichroic mirror 14*a* is reflected by the reflecting mirror 15*c* and is then incident on the liquid crystal light valve for adjusting red light 17R2. After the light intensity (light amount) is adjusted by the liquid crystal light valve for adjusting red light 17R2 , the red light LR is incident on the liquid crystal light valve for red light display 17R1. The liquid crystal light valve for adjusting red light 17R2 is disposed between the liquid crystal light valve for red light display 17R1 and the reflecting mirror 15*c* disposed on the side of the dichroic mirror 14*a*.

On the other hand, among the color light components reflected by the dichroic mirror 14*a*, the green light LG is reflected by the dichroic mirror for green light reflection 14*b* and is then incident on the liquid crystal light valve for adjusting green light 17G2. After the light intensity (light amount) is adjusted by the liquid crystal light valve for adjusting green light 17G2, the green light LG is incident on the liquid crystal light valve for green light display 17G1. The liquid crystal light valve for adjusting green light 17G2 is disposed between the liquid crystal light valve for green light display 17G1 and the dichroic mirror 14*b* disposed on the side of the dichroic mirror 14*a*. On the other hand, the blue light LB is transmitted through the dichroic mirror 14*b* and is then incident on the liquid crystal light valve for adjusting blue light 17B2 through a relay system R1 configured to include a relay lens 16*a*, the reflecting mirror 15*a*, a relay lens 16*b* the reflecting mirror 15*b*, and a relay lens 16*c*. After the light intensity (light amount) is adjusted by the liquid crystal light valve for adjusting blue light 17B2, the blue light LB is incident on the liquid crystal light valve for blue light display 17B1. The liquid crystal light valve for adjusting blue light 17B2 is disposed between the liquid crystal light valve for blue light display 17B1 and the relay lens 16*c* disposed on the side of the dichroic mirror 14*b*.

In the present embodiment, the liquid crystal light valve for adjusting light and the liquid crystal light valve for display are disposed with a predetermined distance therebetween.

The liquid crystal light valve for adjusting light is schematically configured to include a liquid crystal panel and polarizing plates laminated on both sides of the liquid crystal panel. In the liquid crystal panel, a liquid crystal layer is interposed between a pair of glass substrates (light transmissive substrates), light transmissive electrodes are formed on the surfaces of the pair of glass substrates facing the liquid crystal layer, and alignment layers are formed on the surfaces of the light transmissive electrodes facing the liquid crystal layer.

In the case of the liquid crystal light valve for adjusting red light 17R2, when applying a voltage to the light transmissive electrode in response to a driving signal from a light adjusting liquid crystal driving unit 110*b* to be described later, it is possible to freely change the transmission rate in the range from a value close to 0% to 100% by changing the magnitude of the voltage to be applied. Thus, by changing the transmission rate in the range from a value close to 0% to 100%, the intensity (light amount) of the red light LR emitted from the liquid crystal light valve for adjusting red light 17R2 can be changed. Accordingly, by lowering the voltage to be applied according to an image to increase the transmission rate and accordingly increasing the intensity (light amount) of the red light LR or by increasing the voltage to be applied to reduce the transmission rate and accordingly reducing the intensity (light amount) of the red light LR, the intensity (light amount) of the red light LR is adjusted by the liquid crystal light valve for adjusting red light 17R2.

In the case of the liquid crystal light valve for adjusting green light 17G2, when applying a voltage to the light transmissive electrode in response to a driving signal from the light adjusting liquid crystal driving unit 110*b* to be described later, it is possible to freely change the transmission rate in the range from a value close to 0% to 100% by changing the magnitude of the voltage to be applied. Thus, by changing the transmission rate in the range from a value close to 0% to 100%, the intensity (light amount) of the green light LG emitted from the liquid crystal light valve for adjusting green light 17G2 can be changed. Therefore, the intensity (light amount) of the green light LG is adjusted by the liquid crystal light valve for adjusting green light 17G2.

In the case of the liquid crystal light valve for adjusting blue light 17B2, when applying a voltage to the light transmissive electrode in response to a driving signal from the adjusting liquid crystal driving unit 110*b* to be described later, it is possible to freely change the transmission rate in the range from a value close to 0% to 100% by changing the magnitude of the voltage to be applied. Thus, by changing the transmission rate in the range from a value close to 0% to 100%, the intensity (light amount) of the blue light LB emitted from the liquid crystal light valve for adjusting blue light 17B2 can be changed. Therefore, the intensity (light amount) of the blue light LB is adjusted by the liquid crystal light valve for adjusting blue light 17B2.

Three color light components modulated by the liquid crystal light valves for display 17R1, 17G1, and 17B1 are incident on the cross dichroic prism 18. This prism is formed by bonding four rectangular prisms to each other, and a dielectric multilayer film that reflects red light and a dielectric multilayer film that reflects blue light are formed in a cross shape on the inner surface thereof. By the dielectric multilayer films, three color light components are combined to form light that shows a color image. The combined light is projected onto a projection surface SC, such as a screen, by a projection lens 19 that is a projection optical system, and accordingly, an enlarged image is displayed.

In addition, the projector 1 includes a plurality of light adjusting elements, and includes a "lighting unit" that can control independently the amount of light emitted from the light adjusting elements. In the present embodiment, the lighting unit includes the light source device 11 and the liquid crystal light valve for adjusting light. Each "light adjusting element" provided in the lighting unit can adjust the amount of light incident on other optical elements, which are illumination targets, from the light adjusting element. In addition, the lighting unit can also control independently the amount of light emitted from each of the plurality of light adjusting elements. In the present embodiment, light adjusting pixels provided in the liquid crystal light valves for adjusting light 17R2, 17G2, and 17B2 correspond to the light adjusting elements.

Next, the control of the projector 1 of the present embodiment will be described.

In a known projector that does not have a light adjusting function, input image information (video signal) is supplied to the liquid crystal driving unit (liquid crystal panel driver) after appropriate correction processing is performed. However, in the case of a projector having a light adjusting function as in the present embodiment, it is necessary to control the intensity of each color light component based on image information.

Figure 2:
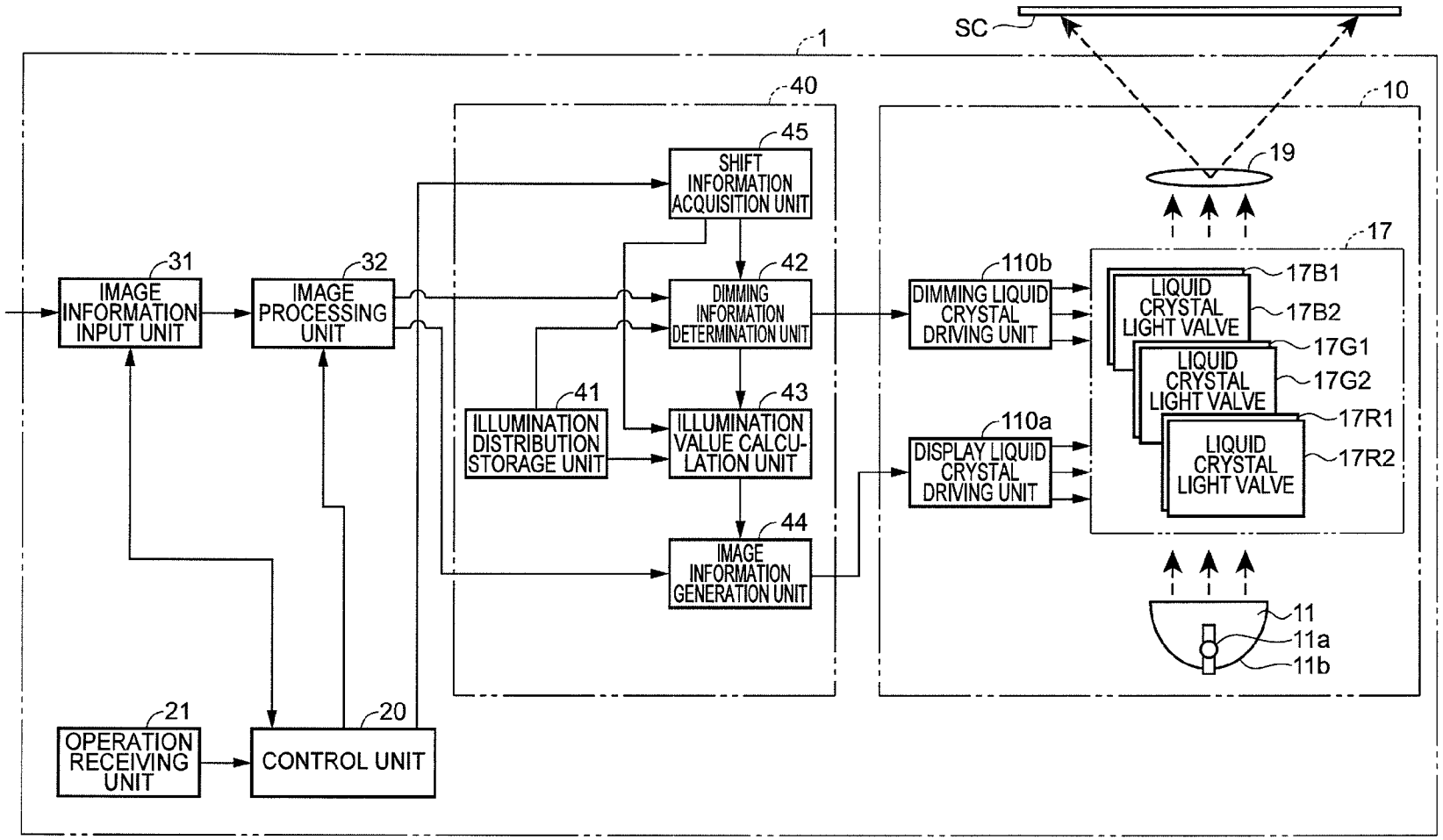
FIG. 2 is a block diagram showing the schematic configuration of the projector according to the first embodiment.

FIG. 2 is a block diagram showing the schematic configuration of the projector 1 according to the first embodiment. As shown in FIG. 2, the projector 1 includes an image projection unit 10 as a display unit, a control unit 20, an operation receiving unit 21, an image information input unit 31, an image processing unit 32, a light valve control unit 40, and the like.

The image projection unit 10 is configured to include the light source device 11, the three liquid crystal light valves for display 17R1, 17G1, and 17B1, the three liquid crystal light valves for adjusting light 17R2, 17G2, and 17B2, the projection lens 19 as a projection optical system, a display liquid crystal driving unit 110*a*, the light adjusting liquid crystal driving unit 110*b*, and the like. In addition, the liquid crystal light valves for display 17R1, 17G1, and 17B1 and the liquid crystal light valves for adjusting light 17R2, 17G2, and 17B2 are also referred to collectively as a liquid crystal light valve unit 17.

In the image projection unit 10, the amount of light emitted from the light source device 11 is adjusted by the liquid crystal light valves for adjusting light 17R2, 17G2, and 17B2, and the light after adjustment is modulated to image light by the liquid crystal light valves for display 17R1, 17G1, and 17B1. The image light is projected from the projection lens 19 so as to be displayed on the projection surface SC as an image.

The light emitted from the light source device 11 is converted into light with approximately uniform brightness distribution by an integrator optical system, such as the fly-eye lenses 12*a* and 12*b*, and is separated into respective color light components of red (R), green (G), and blue (B), which are three primary colors of light, by a color separation optical system, such as the dichroic mirrors 14*a* and 14*b*. Then, the separated color light components are incident on the liquid crystal light valves for display 17R1, 17G1, and 17B1 and the liquid crystal light valves for adjusting light 17R2, 17G2, and 17B2.

The liquid crystal light valves for display 17R1, 17G1, and 17B1 and the liquid crystal light valves for adjusting light 17R2, 17G2, and 17B2 are formed by a liquid crystal panel in which liquid crystal is sealed between a pair of transparent substrates, for example. Each of the liquid crystal light valves for display 17R1, 17G1, and 17B1 and the liquid crystal light valves for adjusting light 17R2, 17G2, and 17B2 includes a rectangular pixel region where a plurality of display pixels and a plurality of light adjusting pixels (light adjusting elements) are arrayed in a matrix, so that it is possible to apply a driving voltage to liquid crystal for each pixel.

When the light adjusting liquid crystal driving unit 110*b* applies a driving voltage corresponding to the light adjusting pixel value (the amount of light adjustment) to each light adjusting pixel, each light adjusting pixel is set to a light transmittance corresponding to the light adjusting pixel value. Therefore, the light emitted from the light source device 11 is output as light corresponding to the amount of light adjustment after the amount of light is adjusted by being transmitted through the pixel region of the liquid crystal light valves for adjusting light 17R2, 17G2, and 17B2. Light output from the liquid crystal light valves for adjusting light 17R2, 17G2, and 17B2 illuminates the liquid crystal light valves for display 17R1, 17G1, and 17B1, respectively.

When the display liquid crystal driving unit 110*a* applies a driving voltage corresponding to image information to each display pixel, each display pixel is set to a light transmittance corresponding to the image information. Therefore, the light emitted from the liquid crystal light valves for adjusting light 17R2, 17G2, and 17B2 is modulated by being transmitting through the pixel region of the liquid crystal light valves for display 17R1, 17G1, and 17B1, and image light corresponding to the image information is formed for each color light component. The formed image light components of the respective colors are combined by a color combining optical system (not shown in FIG. 2) for each pixel, thereby obtaining color image light. Then, the color image light is enlarged and projected by the projection lens 19.

The control unit 20 includes a central processing unit (CPU), a RAM used when storing various kinds of data or the like temporarily, a nonvolatile ROM, and the like. The CPU operates according to a control program stored in the ROM, thereby performing overall control of the operation of the projector 1. That is, the control unit 20 functions as a computer.

The operation receiving unit 21 includes a plurality of operation keys used when a user sends various kinds of instructions to the projector 1. Operation keys provided in the operation receiving unit 21 of the present embodiment include a power key for ON/OFF switching of a power supply, an input switching key for switching of an input video signal, a menu key for displaying a menu image for various settings, a direction key used when selecting an item in the menu image or the like, and a determination key for confirming the selected item.

When a user operates various operation keys of the operation receiving unit 21, the operation receiving unit 21 receives the operation and outputs a control signal corresponding to the operated operation key to the control unit 20. Then, when the control signal from the operation receiving unit 21 is input, the control unit 20 controls the operation of the projector 1 by performing processing based on the input control signal. Instead of the operation receiving unit 21 or in addition to the operation receiving unit 21, a remote control (not shown) that can be remotely controlled may be used as an input operation unit. In this case, the remote control transmits an operation signal such as an infrared ray corresponding to the operation content of the user, and a remote control signal receiving unit (not shown) receives the operation signal and transmits the operation signal to the control unit 20.

The image information input unit 31 includes a plurality of input terminals. Through the input terminals, image information in various formats is input from an external image supply apparatus (not shown), such as a video reproduction apparatus or a personal computer. The image information input unit 31 selects image information according to the instruction from the control unit 20, and outputs the selected image information to the image processing unit 32. The image information corresponds to first image information.

The image processing unit 32 converts the image information input from the image information input unit 31 into image information indicating the gradation of each display pixel. In addition, the image processing unit 32 performs image quality adjustment processing for adjusting the image quality, such as brightness, contrast, sharpness, and hue, for the converted image information according to the instruction from the control unit 20. In addition, the image processing unit 32 can also superimpose an onscreen display (OSD) image, such as a menu image, on the input image. Then, the image processing unit 32 outputs the processed image information to a light adjusting information determination unit 42 and an image information generation unit 44 of the light valve control unit 40. In addition, the image processing unit 32 can control the pixel value output to each pixel of the liquid crystal light valve for display and the liquid crystal light valve for adjusting light, and can output various kinds of image information, such as a test pattern image and a white image that are different from the input image.

The light valve control unit 40 is configured to include the illumination distribution storage unit 41, the light adjusting information determination unit 42, an illumination value calculation unit 43, the image information generation unit 44, and a shift information acquisition unit 45. The light valve control unit 40 corresponds to a light modulation control unit.

The illumination distribution storage unit 41 is configured to include a nonvolatile memory. The illumination distribution storage unit 41 stores the illumination range and the intensity distribution when the light emitted from each light adjusting pixel of the liquid crystal light valves for adjusting light 17R2, 17G2, and 17B2 illuminates the liquid crystal light valves for display 17R1, 17G1, and 17B1. As a storage form, a look-up table (LUT) may be used, or a function may be used. Here, the intensity distribution corresponds to the distribution information of the illumination intensity.

The illumination range and the intensity distribution are determined by the arrangement relationship between the liquid crystal light valve for adjusting light and the liquid crystal light valve for display. In addition, the information of the illumination range and the intensity distribution is stored for each color light component according to the arrangement relationship between the liquid crystal light valve for adjusting light and the liquid crystal light valve for display. In addition, as long as the arrangement relationship for the respective color light components is the same, the information of the illumination range and the intensity distribution may be stored for only one of the color light components.

Here, the illumination range and the intensity distribution will be described.

Figure 3:
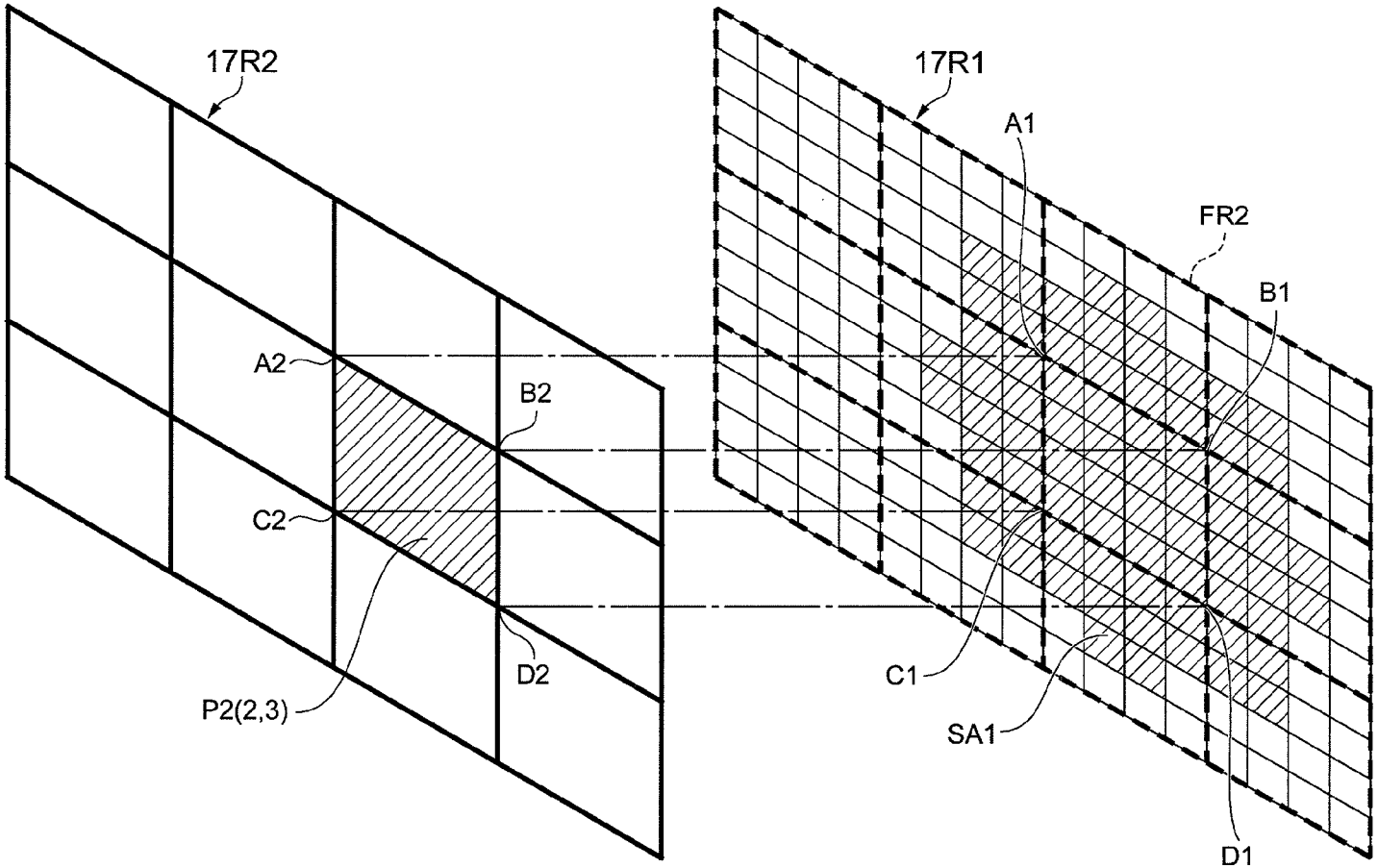
FIG. 3 is a perspective view showing the arrangement of liquid crystal light valves for adjusting light and liquid crystal light valves for display.

FIG. 3 is a perspective view showing the arrangement of the liquid crystal light valve for adjusting light 17R2 and the liquid crystal light valve for display 17R1.

Figure 4A:
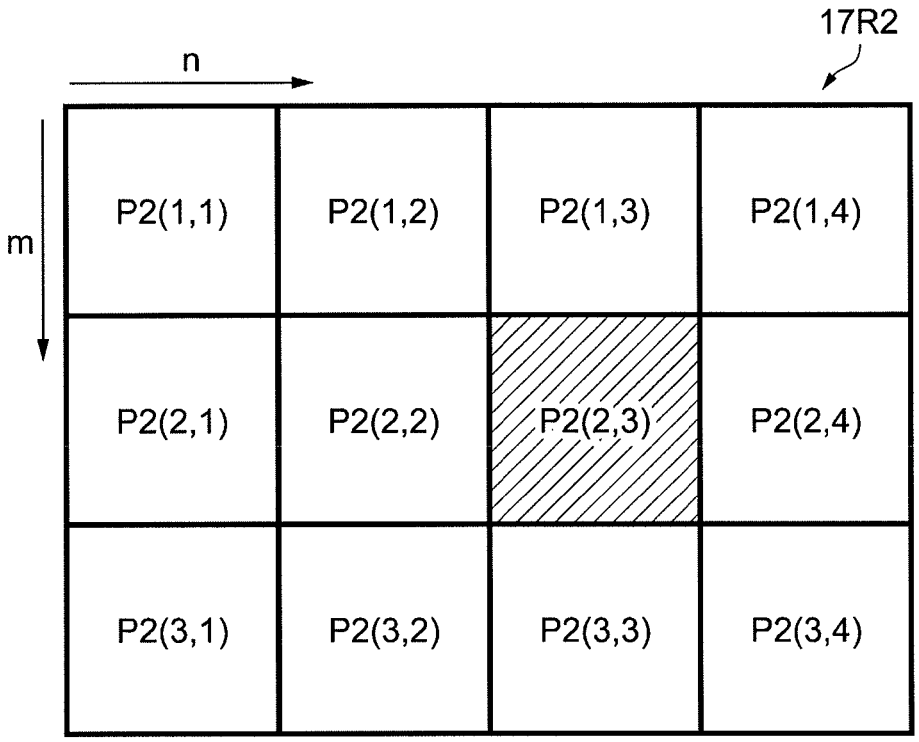
FIG. 4A is a front view of a liquid crystal light valve for adjusting light.
Figure 4B:
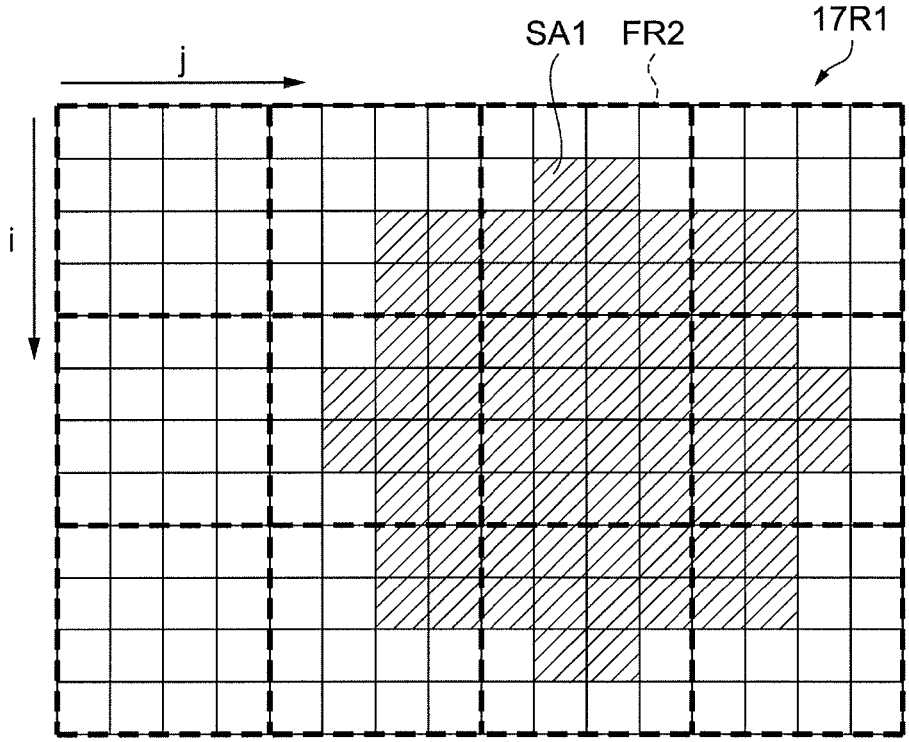
FIG. 4B is a front view of a liquid crystal light valve for display.

FIG. 4A is a front view of the liquid crystal light valve for adjusting light 17R2, and FIG. 4B is a front view of the liquid crystal light valve for display 17R1.

In FIGS, 4A, and 4B, the liquid crystal light valve for adjusting light 17R2 and the liquid crystal light valve for display 17R1 are shown. Although not shown, the liquid crystal light valves for adjusting light 17G2 and 17B2 and the liquid crystal light valve for display 17G1 and 17B1 are assumed to have the same configuration. Explanation herein will be given using the liquid crystal light valve for adjusting light 17R2 and the liquid crystal light valve for display 17R1.

In the present embodiment, for the sake of simplicity, the liquid crystal light valve for adjusting light 17R2 is configured to have light adjusting pixels of 3 rows×4 columns. The coordinates of each light adjusting pixel are expressed as (m, n). In addition, the liquid crystal light valve for display 17R1 is configured to have display pixels of 12 rows×6 columns. The coordinates of each display pixel are expressed as (i, j). In addition, in the present embodiment, one light adjusting pixel of the liquid crystal light valve for adjusting light 17R2 is set to have a size corresponding to the 4×4 display pixels of the liquid crystal light valve for display 17R1. Accordingly, a dashed line FR2 showing the position of the light adjusting pixel of the liquid crystal light valve for adjusting light 17R2 is displayed so as to be superimposed on the liquid crystal light valve for display 17R1 shown in FIGS. 3 and 4B.

Here, as shown in FIGS. 3, 4A, and 4B, one light adjusting pixel (in FIG. 3, a shaded portion having four corners A2, B2, C2, and D2) of the liquid crystal light valve for adjusting light 17R2 is assumed to be an observed light adjusting pixel P2(2, 3). Light having passed through the observed light adjusting pixel reaches not only 4×4 display pixels (a region having four corners A1, B1, C1, and D1) of the liquid crystal light valve for display 17R1 corresponding to the observed light adjusting pixel but also display pixels around the 4×4 display pixels. That is, display pixels around the observed light adjusting pixel are also illuminated due to the spread of light having passed through the observed light adjusting pixel.

Here, it is assumed that the light having passed through the observed light adjusting pixel P2(2, 3) of the liquid crystal light valve for adjusting light 17R2 reaches a region of the shaded portion of the liquid crystal light valve for display 17R1. The region of the shaded portion is assumed to be an illumination range SA1. In FIGS. 3, 4A, and 4B, the arrangement relationship between the liquid crystal light valve for adjusting light 17R2 and the liquid crystal light valve for display 17R1 is a state where there is no position shift.

Next, a case where there is a position shift in the arrangement relationship between the liquid crystal light valve for adjusting light 17R2 and the liquid crystal light valve for display 17R1 will be described.

Figure 5:
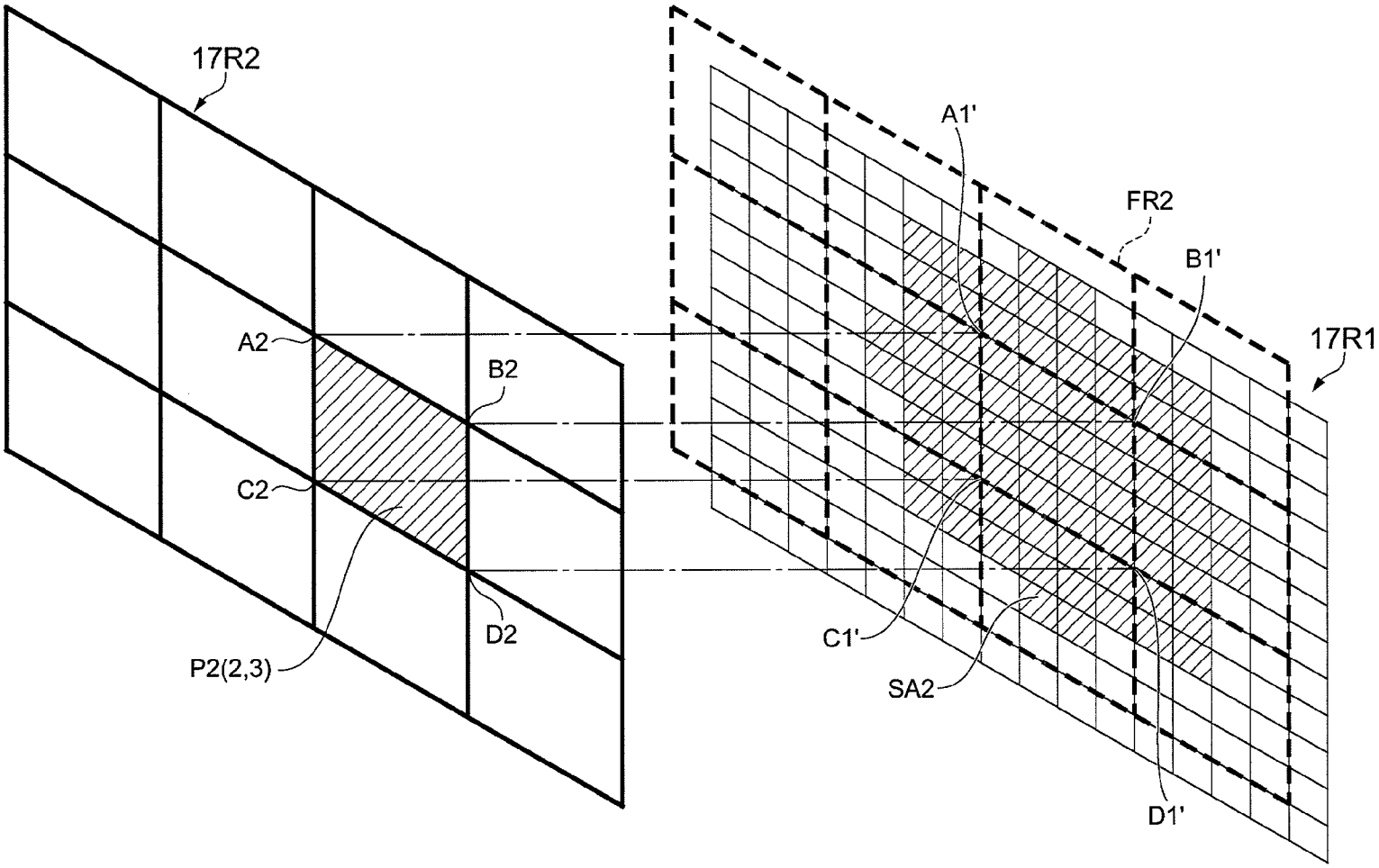
FIG. 5 is a perspective view showing a state where there is a position shift in the arrangement relationship between the liquid crystal light valve for adjusting light and the liquid crystal light valve for display.

FIG. 5 is a perspective view showing a state where there is position shift in the arrangement relationship between the liquid crystal light valve for adjusting light 17R2 and the liquid crystal light valve for display 17R1.

Figure 6A:
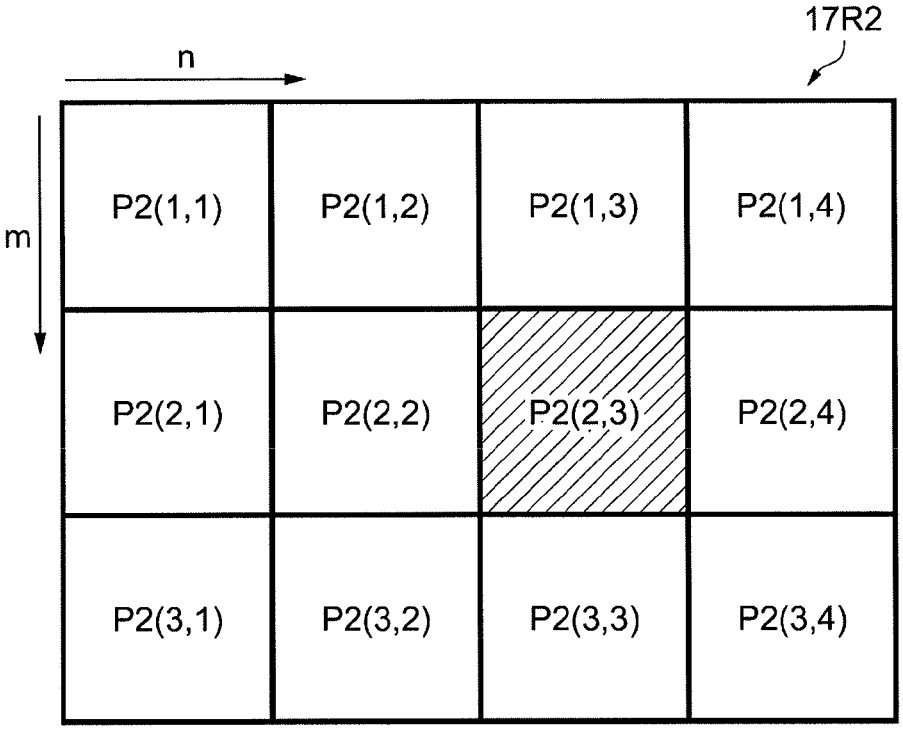
FIGS. 6A and 6B are front views when there is a position shift in the arrangement relationship between the liquid crystal light valve for adjusting light and the liquid crystal light valve for display, where
Figure 6B:
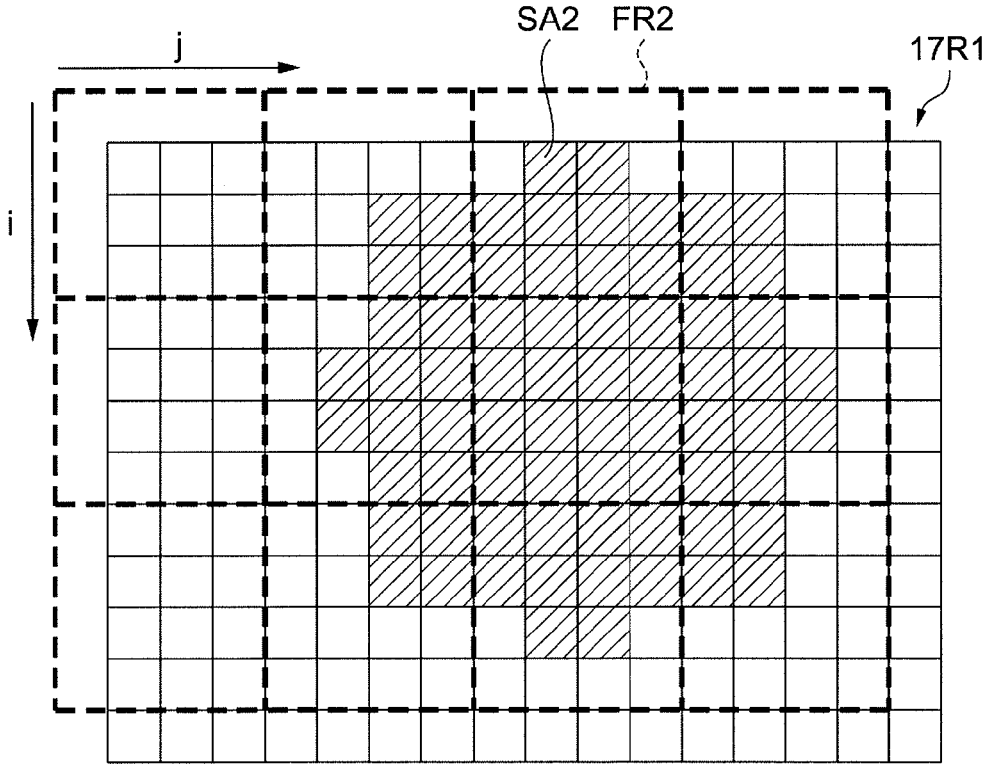

FIGS. 6A and 6B are front views when there is a position shift in the arrangement relationship between the liquid crystal light valve for adjusting light 17R2 and the liquid crystal light valve for display 17R1, where FIG. 6A is a front view of the liquid crystal light valve for adjusting light 17R2, and FIG. 6B is a front view of the liquid crystal light valve for display 17R1.

In FIGS. 5, 6A, and 6B, the liquid crystal light valve for adjusting light 17R2 and the liquid crystal light valve for display 17R1 are shown. Here, for the sake of explanation, a dashed line FR2 showing the position of the light adjusting pixel of the liquid crystal light valve for adjusting light 17R2 is displayed so as to be superimposed on the liquid crystal light valve for display 17R1 shown in FIGS. 5 and 6B.

As shown in FIG. 5, the position of the liquid crystal light valve for display 17R1 is shifted from the dashed line FR2. That is, the positions of the liquid crystal light valve for adjusting light 17R2 and the liquid crystal light valve for display 17R1 are shifted from each other. Specifically, 4×4 display pixels of the liquid crystal light valve for display 17R1 corresponding to one light adjusting pixel P2(2, 3) of the liquid crystal light valve for adjusting light 17R2, that is, a shaded portion having four corners A2, B2, C2, and D2 is a region having four corners A1', B1', C1', and D1'. Thus, when viewed from the incidence direction of light, the liquid crystal light valve for adjusting light 17R2 is shifted from the liquid crystal light valve for display 17R1 by one display pixel in the upper direction (−i direction) and one display pixel in the left direction (−j direction). Such position shift information is acquired by the shift information acquisition unit 45. Although the position shift information is one display pixel in the upper direction and one display pixel in the left direction in the present embodiment, the position shift information is not limited thereto. In addition, when a position shift occurs as described above, if the size of the region of the liquid crystal light valve for display is equal to that of the liquid crystal light valve for adjusting light, a region where illumination light does not reach is present on the liquid crystal light valve for display. For this reason, it is preferable to increase the number of pixels of the liquid crystal light valve for adjusting light so that the liquid crystal light valve for adjusting light can illuminate a range wider than that illuminated by the liquid crystal light valve for display.

As shown in FIGS. 5, 6A, and 6B, assuming that one light adjusting pixel (a shaded portion having four corners A2, B2, C2, and D2) of the liquid crystal light valve for adjusting light 17R2 is the observed light adjusting pixel P2(2, 3), light having passed through the observed light adjusting pixel reaches not only 4×4 display pixels (a region having four corners A1', B1', C1', and D1') of the liquid crystal light valve for display 17R1 corresponding to the observed light adjusting pixel but also display pixels around the 4×4 display pixels. That is, display pixels around the observed light adjusting pixel are also illuminated due to the spread of light having passed through the observed light adjusting pixel.

In FIGS. 5, 6A, and 6B, it is assumed that the light having passed through the observed light adjusting pixel P2(2, 3) of the liquid crystal light valve for adjusting light 17R2 reaches a region (illumination range SA2) of the shaded portion of the liquid crystal light valve for display 17R1. On the liquid crystal light valve for display 17R1, the illumination range SA2 is shifted from the illumination range SA1 shown in FIG. 4B by one display pixel in the upper direction and one display pixel in the left direction. Hereinafter, the process of calculating the amount of light adjustment (pixel value) of the light adjusting pixel of the liquid crystal light valve for adjusting light and the pixel signal (second image information (pixel value)) of the display pixel of the liquid crystal light valve for display in consideration of such an illumination range shift will be described.

As the illumination range SA1 shown in FIG. 4B and the illumination range SA2 shown in FIG. 6B, when the positions of the liquid crystal light valve for adjusting light 17R2 and the liquid crystal light valve for display 17R1 are shifted from each other in a direction perpendicular to the optical axis, the illumination positions are shifted from each other, but the illumination shapes and the illumination sizes are approximately the same as before the shift. In the present embodiment, such a position shift is assumed, and the illumination shape and the illumination size are referred to as an illumination range SA. The illumination range SA is determined by the arrangement relationship between the liquid crystal light valve for adjusting light 17R2 and the liquid crystal light valve for display 17R1 in the optical axis direction. The illumination range is measured in advance during development of the products and is stored in the illumination distribution storage unit 41.

FIG. 7 is an explanatory view of the intensity distribution in the illumination range SA of the liquid crystal light valve for display. As shown in FIG. 7, an illumination intensity S is written for each display pixel in the illumination range SA. The illumination intensity S increases as movement is made toward the center, and decreases as movement is made toward the periphery. The illumination intensity S is determined through the arrangement relationship between the liquid crystal light valve for adjusting light 17R2 and the liquid crystal light valve for display 17R1. The illumination intensity S is measured in advance during development of the products and is stored in the illumination distribution storage unit 41 together with the illumination range SA. Here, the illumination intensity S of each display pixel is expressed by a value of "0" or more and "1" or less.

Referring back to FIG. 2, the shift information acquisition unit 45 acquires the information of a position shift of the liquid crystal light valve for adjusting light with respect to the liquid crystal light valve for display. In the present embodiment, the position shift information is input by a user. Specifically, the user operates the operation receiving unit 21, such as an operation panel, provided in the projector 1 and displays a menu image or the like in order to set a position shift information input mode (not shown). The position shift information input mode is a mode in which a user can input position shift information to the projector 1. Thereafter, the user inputs position shift information according to the screen display in the position shift information input mode. In the present embodiment, the number of display pixels in the liquid crystal light valve for display is used as an input unit of the position shift information. Then, a position shift of the liquid crystal light valve for adjusting light with respect to the liquid crystal light valve for display is input for the i and j directions. The input position shift information is stored in a storage region (not shown), such as a nonvolatile memory of the control unit 20. The shift information acquisition unit 45 acquires the position shift information from the storage region of the control unit 20.

In the present embodiment, the information of a position shift of the liquid crystal light valve for adjusting red light 17R2 with respect to the liquid crystal light valve for red light display 17R1, the information of a position shift of the liquid crystal light valve for adjusting green light 17G2 with respect to the liquid crystal light valve for green light display 17G1, and the information of a position shift of the liquid crystal light valve for adjusting blue light 17B2 with respect to the liquid crystal light valve for blue light display 17B1 can be input and stored in a storage region. Thereafter, the shift information acquisition unit 45 acquires each piece of the position shift information from the storage region of the control unit 20. In addition, the light adjusting information determination unit 42, the illumination value calculation unit 43, and the image information generation unit 44, which will be described later, perform light valve control for each color light component based on the position shift information.

For each light adjusting pixel, the light adjusting information determination unit 42 shifts the illumination range of the liquid crystal light valve for display according to the position shift information input from the shift information acquisition unit 45, and determines the amount of light adjustment of the light adjusting pixel of the liquid crystal light valve for adjusting light based on the feature quantity of the first image information corresponding to the display pixel in the illumination range. In the present embodiment, a maximum value of the first image information corresponding to the display pixel included in the illumination range SA of the light adjusting pixel is set as the feature quantity. For example, for the light adjusting pixel P2(2, 3) of the liquid crystal light valve for adjusting light 17R2, the maximum value of the first image information corresponding to the display pixel in the illumination range SA2 is set as the amount of light adjustment (gradation (pixel value)).

In addition, the projector 1 may perform various kinds of image processing on the first image information. In this case, the light adjusting information determination unit 42 may determine the feature quantity based on the first image information after various kinds of image processing are performed. For example, when the number of pixels of the first image information does not match the number of pixels of the liquid crystal light valves for display 17R1, 17G1, and 17B1, the projector 1 may perform a resizing process (resolution conversion process) on the first image information so that the number of pixels of the first image information matches the number of pixels of the liquid crystal light valves for display 17R1, 17G1, and 17B1. In such a case, image information after the resizing process is performed may be defined as the first image information. In this case, the light adjusting information determination unit 42 may determine the feature quantity based on the image information after the resizing process is performed.

Here, in consideration of the position shift information "one display pixel in the –i direction and one display pixel in the –j direction", assuming that the gradation (pixel value) of the first image information corresponding to a display pixel (i, j) included in an illumination range SA(m, n) by a light adjusting pixel(m, n) is In_P1(i, j), the following Expression (1) is satisfied.

$$0 \leq In_P1(i, j) \leq 1, (i, j) \in SA(m, n) \quad (1)$$

In addition, assuming that the maximum value (feature quantity) of the first image information corresponding to the light adjusting pixel (m, n) is F(m, n), the following Expression (2) is satisfied.

$$F(m, n) = \max(In_P1(i, j)) \quad (2)$$

In addition, as shown in the following Expression (3), the maximum value (feature quantity) of the first image information corresponding to the light adjusting pixel (m, n) is assumed to be the amount of light adjustment (pixel value) A(m, n) of the light adjusting pixel (m, n).

$$A(m, n) = F(m, n) \quad (3)$$

The illumination value calculation unit 43 calculates the illumination value of light reaching each display pixel of the liquid crystal light valve for display 17R1 based on the amount of light adjustment (pixel value) of the light adjusting pixel of the liquid crystal light valve for adjusting light and the distribution information of the illumination intensity S in the liquid crystal light valve for display.

First, the illumination value calculation unit 43 extracts a light adjusting pixel, for which illumination light reaches an observed display pixel of the liquid crystal light valve for display, from all light adjusting pixels of the liquid crystal light valve for adjusting light. Specifically, for example, for each light adjusting pixel of the liquid crystal light valve for adjusting light 17R2, in consideration of "one display pixel in the –i direction and one display pixel in the –j direction" that is the position shift amount, the illumination value calculation unit 43 determines whether or not an observed display pixel is included in the illumination range SA (for example, SA2) in which the light having passed through each light adjusting pixel reaches the liquid crystal light valve for display 17R1, and extracts the light adjusting pixel when an observed display pixel is included in the illumination range SA. In the present embodiment, assuming that the observed display pixel is (i, j)=(6, 11), four light adjusting pixels of P2(2, 3), P2(3, 3), P2(2, 4), and P2(3, 4) of the liquid crystal light valve for adjusting light 17R2 are extracted.

Then, the illumination value calculation unit 43 calculates the brightness with which the observed display pixel of the liquid crystal light valve for display 17R1 is illuminated by each light adjusting pixel extracted on the liquid crystal light valve for adjusting light 17R2. Here, the brightness necessary to illuminate the liquid crystal light valve for display 17R1 by each light adjusting pixel of the liquid crystal light valve for adjusting light 17R2 can be calculated by multiplying the amount of light adjustment A(m, n) of each light adjusting pixel by the distribution of the illumination intensity S.

Assuming that the brightness with which the observed display pixel (i, j) of the liquid crystal light valve for display 17R1 is illuminated is L(i, j), L(i, j) can be calculated with the sum of light that reaches the observed display pixel from each of four light adjusting pixels extracted from the liquid crystal light valve for adjusting light 17R2. Here, the illumination intensity S(i, j, m, n) indicates an illumination intensity corresponding to the positional relationship between the light adjusting pixel P2(m, n) and the observed display pixel P1(i, j) of the liquid crystal light valve for display 17R1. In this case, the position of the liquid crystal light valve for adjusting light 17R2 is shifted from the position of the liquid crystal light valve for display 17R1 by "one display pixel in the –i direction and one display pixel in the –j direction". Therefore, also for the illumination intensity S(i, j, m, n), a value after shifting by the amount of the position shift is acquired. The brightness L(i, j) with which the observed display pixel(i, j) is illuminated is expressed by the following Expression (4).

$$L(i, j) = \Sigma A(m, n) \times S(i, j, m, n) \quad (4)$$

where, $0 \leq L(i, j) \leq 1$. In addition, $m, n \in SB(i, j)$

SB(i, j) is a set of light adjusting pixels (m, n) that illuminate the observed display pixel (i, j), and Σ(sigma) for all light adjusting pixels (m, n) included in the SB(i, j) is calculated. In the present embodiment, (m, n) indicates the four extracted light adjusting pixels P2(2, 3), P2(3, 3), P2(2, 4), and P2(3, 4) that illuminate the observed display pixel(i, j)=(6, 11).

The image information generation unit 44 calculates a pixel signal of the observed display pixel, that is, second image information based on the first image information input from the image processing unit 32 and the illumination value L(i, j) of light reaching the observed display pixel of the liquid crystal light valve for display 17R1, which has been calculated by the illumination value calculation unit 43. Here, the image information generation unit 44 sets a value, which is obtained by dividing the first image information corresponding to the observed display pixel by the brightness with which the observed display pixel is illuminated, as a pixel signal (second image information (pixel value)) Out_P1(i, j) of the observed display pixel. Then, Out_P1(i, j) is expressed by the following Expression (5).

$$Out_P1(i, j) = In_P1(i, j)/L(i, j) \quad (5)$$

where, $0 \leq Out_P1(i, j) \leq 1$

In addition, as described above, in the present embodiment, a value, such as a pixel value or the brightness, is expressed as a gradation of "0" or more and "1" or less.

The light adjusting liquid crystal driving unit 110*b* drives the liquid crystal light valves for adjusting light 17R2, 17G2, and 17B2 according to the amount of light adjustment A(m, n) input from the light adjusting information determination unit 42, and the display liquid crystal driving unit 110*a* drives the liquid crystal light valves for display 17R1, 17G1, and 17B1 according to second image information Out_P1(i, j) input from the image information generation unit 44. Accordingly, the light emitted from the light source device 11 is adjusted (dimmed) by the liquid crystal light valves for adjusting light 17R2, 17G2, and 17B2, and is modulated to image light corresponding to the second image information by the liquid crystal light valves for display 17R1, 17G1, and 17B1. This image light is projected from the projection lens 19.

Next, a process that the light valve control unit 40 of the projector 1 performs for each frame or each sub-frame will be described with reference to the flowchart.

Figure 8:
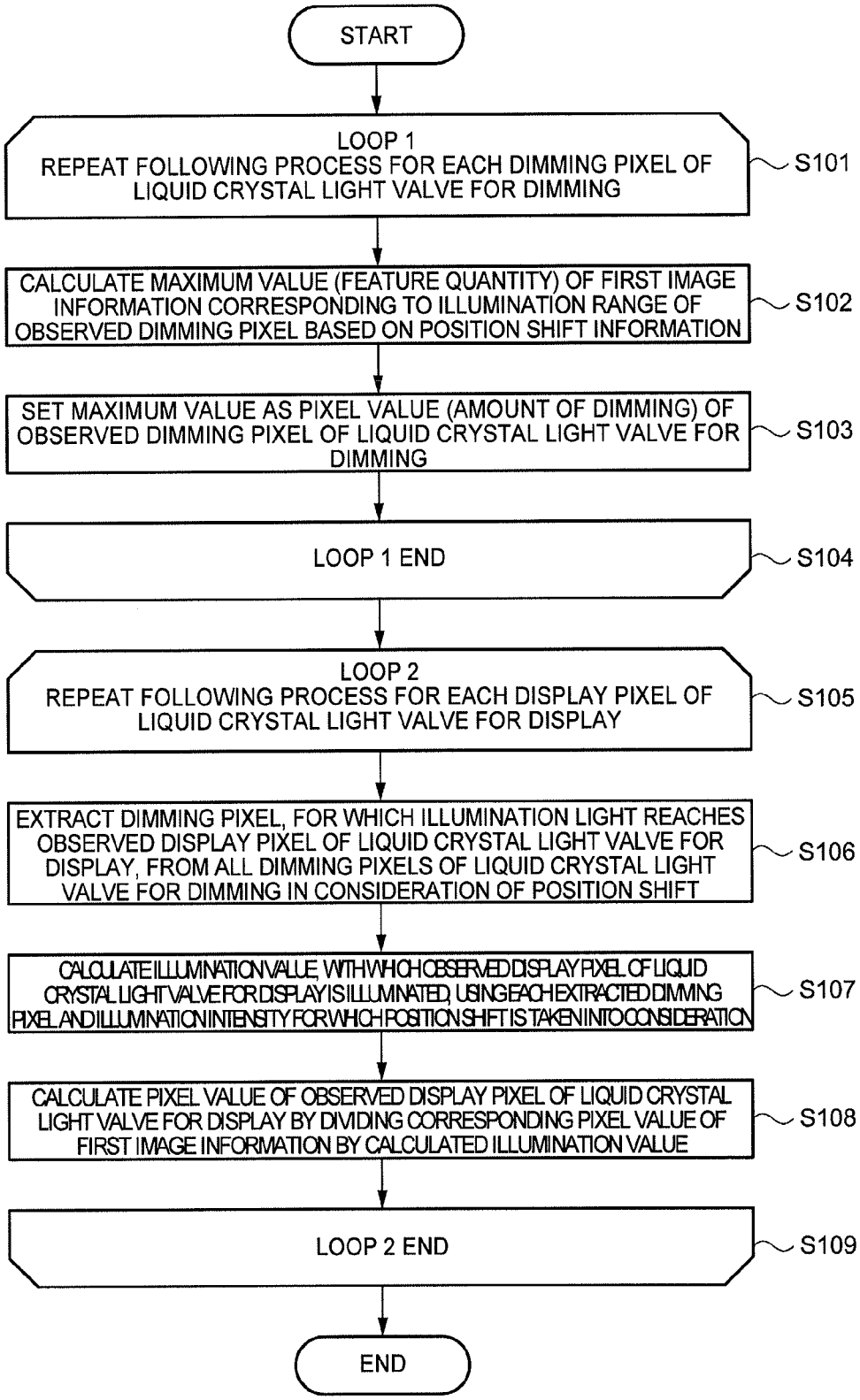
FIG. 8 is a flowchart of the process performed by a light valve control unit of the projector.

FIG. 8 is a flowchart of the process performed by the light valve control unit 40 of the projector 1.

The light valve control unit 40 repeats the process of steps S101 to S104 for each light adjusting pixel of the liquid crystal light valve for adjusting light (loop 1) (step S101).

First, the light adjusting information determination unit 42 calculates a maximum value (feature quantity) F(m, n) of the first image information corresponding to the display pixel in the illumination range SA of the observed light adjusting pixel (step S102). In this case, the illumination range SA is shifted based on position shift information. Then, the light adjusting information determination unit 42 sets the maximum value as a pixel value (the amount of light adjustment) A(m, n) of the observed light adjusting pixel of the liquid crystal light valve for adjusting light (step S103). Then, the process returns to step S101 to repeat the process with the next light adjusting pixel as an observed light adjusting pixel (step S104).

Thus, for all of the light adjusting pixels of the liquid crystal light valve for adjusting light, the pixel value (the amount of light adjustment) A(m, n) is determined. This pixel value (the amount of light adjustment) corresponds to light adjusting information.

Then, the light valve control unit 40 repeats the process of steps S105 to S109 for each display pixel of the liquid crystal light valve for display (loop 2) (step S105).

First, the illumination value calculation unit 43 extracts a light adjusting pixel, for which illumination light reaches the observed display pixel (i, j) of the liquid crystal light valve for display, from all of the light adjusting pixels of the liquid crystal light valve for adjusting light in consideration of the position shift of the liquid crystal light valve for adjusting light with respect to the liquid crystal light valve for display (step S106). Then, the illumination value L(i, j) with which the observed display pixel of the liquid crystal light valve for display is illuminated is calculated using each extracted light adjusting pixel and the illumination intensity S(i, j, m, n) for which the position shift has been taken into consideration (step S107).

The image information generation unit 44 calculates the pixel value (second image information) Out_P1(i, j), which is set for the observed display pixel of the liquid crystal light valve for display, by dividing the corresponding pixel value of the first image information by the calculated illumination value (step S108). Then, the process returns to step S105 to repeat the process with the next display pixel as an observed display pixel (step S109).

When the process is completed for all of the display pixels, the light valve control unit 40 ends the process performed for each frame or each sub-frame. Then, this process is repeatedly performed for the next frame or sub-frame. Each light adjusting pixel value (the amount of light adjustment) A(m, n) of the liquid crystal light valve for adjusting light and each display pixel value (second image information) Out_P1(i, j) of the liquid crystal light valve for display, which have been generated through this process, are output to the light adjusting liquid crystal driving unit 110*b* and the display liquid crystal driving unit 110*a*, respectively. Then, the liquid crystal light valve for adjusting light and the liquid crystal light valve for display are driven according to the pixel value.

According to the first embodiment described above, the following effects are obtained.

(1) The projector 1 includes the liquid crystal light valves for display 17R1, 17G1, and 17B1 including display pixels and the liquid crystal light valve for adjusting light 17R2, 17G2, and 17B2 including light adjusting pixels. The projector 1 shifts an illumination range on the liquid crystal light valve for display, which is illuminated by the light having passed through the light adjusting pixel, based on the position shift information, and performs light adjustment by using the maximum value of the pixel value of the first image information corresponding to the display pixel corresponding to the shifted illumination range as a pixel value (that is, the amount of light adjustment (light adjusting information)) A(m, n) of the light adjusting pixel of the liquid crystal light valve for adjusting light. Therefore, based on the pixel value of the first image information corresponding to the display pixel corresponding to the illumination range based on the position shift of the illumination light from each light adjusting pixel, each light adjusting pixel of the liquid crystal light valve for adjusting light can perform appropriate light adjustment. For example, when a bright pixel is present in the first image information, it is possible to perform light adjustment so as to reproduce the brightness, thus, it is advantageous.

(2) In the projector 1, the illumination value L(i, j) of light reaching each display pixel of the liquid crystal light valve for display is calculated based on the light adjusting pixel value (the amount of light adjustment) A(m, n) and the distribution information of the illumination intensity S(i, j, m, n) for which the position shift has been taken into consideration. In addition, the second image information Out_P1(i, j) to be set for the liquid crystal light valve for display is generated by dividing the first image information In_P1(i, j) by the illumination value L(i, j) of each display pixel. Therefore, it is possible to generate the second image information Out_P1(i, j) for which illumination light corresponding to the position shift from the liquid crystal light valve for adjusting light has been taken into consideration. That is, it is possible to realize a gradation expression almost faithful to the input first image information In_P1(i, j) while taking the illumination light into consideration, thus it is advantageous.

(3) The projector 1 includes the liquid crystal light valves for display 17R1, 17G1, and 17B1 and the liquid crystal light valve for adjusting light 17R2, 17G2, and 17B2. Since the brightness of light incident on the liquid crystal light valve for display can be controlled by the liquid crystal light valves for adjusting light, it is possible to reproduce the first image information (video signal), which is input, with high contrast, thus it is advantageous.

(4) In the projector 1, the illumination range SA and the illumination intensity S when the light having passed through the light adjusting pixels of the liquid crystal light valves for adjusting light 17R2, 17G2, and 17B2 illuminates the display pixels of the liquid crystal light valves for display 17R1, 17G1, and 17B1 are stored in the illumination distribution storage unit 41. The illumination range SA and the illumination intensity S are determined by the arrangement relationship between each liquid crystal light valve for adjusting light and the corresponding liquid crystal light valve for display. The illumination range SA and the illumination intensity S are measured in advance during development of the products and are stored in the illumination distribution storage unit 41. Changes in the illumination range SA and the illumination intensity S due to the device configuration (for example, a distance between the liquid crystal light valve for adjusting light and the liquid crystal light valve for display, an optical element between the liquid crystal light valve for adjusting light and the liquid crystal light valve for display, and the incidence angle characteristics of illumination light) of products can be considered. In the present embodiment, it is possible to cope with the changes in the device configuration of products by rewriting the information stored in the illumination distribution storage unit 41, thus it is advantageous.

(5) In the projector 1, the operation receiving unit 21 receives the input of position shift information, and stores the position shift information in the control unit 20. The shift information acquisition unit 45 acquires the position shift information from the control unit 20. Then, based on the position shift information, the light valve control unit of the projector 1 performs light valve control corresponding to the position shift. Therefore, the user can input the position shift information. As a result, even when a position shift occurs in the liquid crystal light valve for adjusting light and the liquid crystal light valve for display, it is possible to reproduce the gradation correctly.

Second Embodiment

Hereinafter, as a second embodiment, a projector capable of detecting the position shift between the liquid crystal light valve for adjusting light and the liquid crystal light valve for display will be described with reference to the accompanying diagrams.

A schematic configuration diagram showing an optical unit of the projector according to the second embodiment is the same as FIG. 1 in the first embodiment. Therefore, explanation thereof will be omitted.

Figure 9:
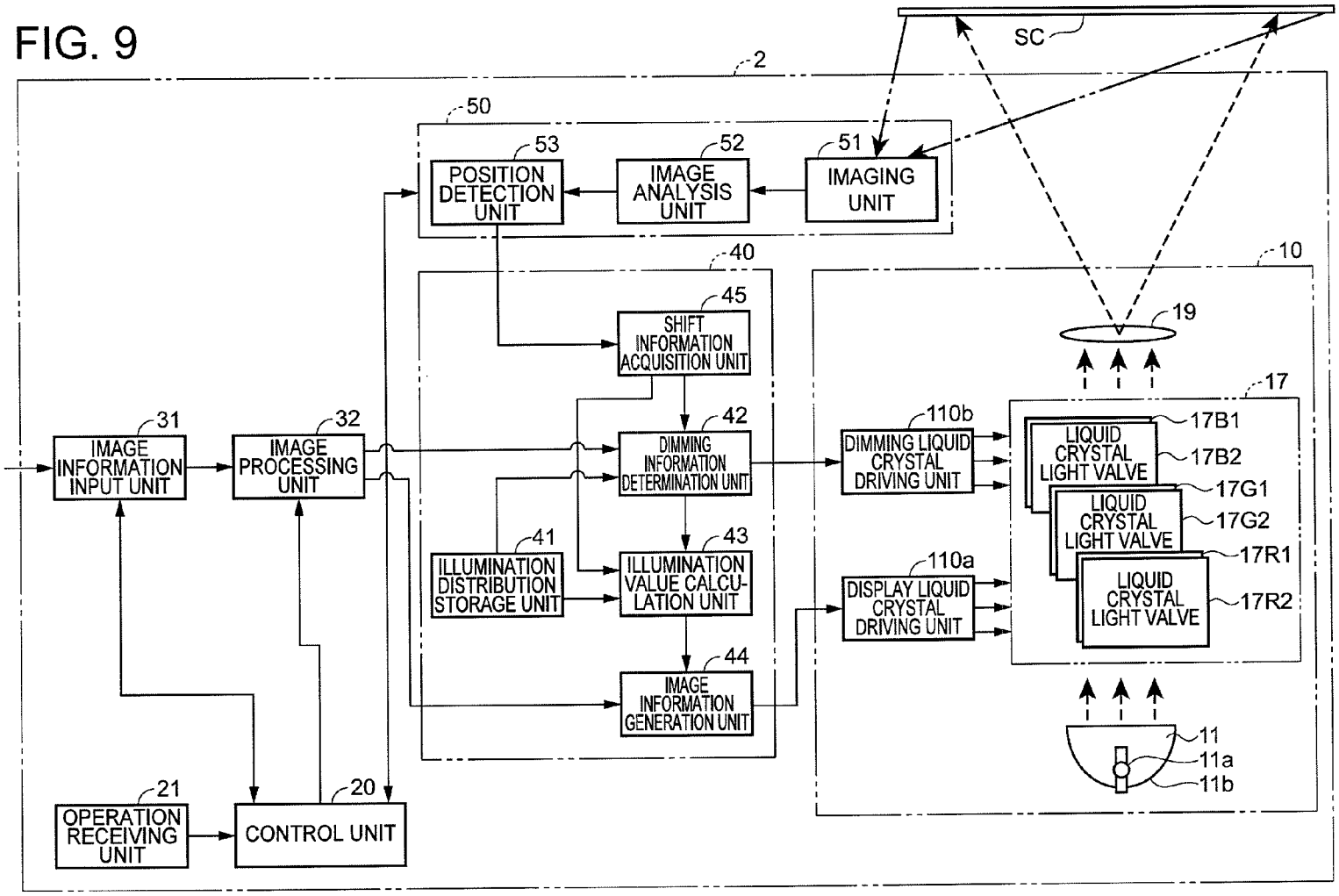
FIG. 9 is a block diagram showing the schematic configuration of a projector according to a second embodiment.

FIG. 9 is a block diagram showing the schematic configuration of a projector 2 according to the second embodiment. As shown in FIG. 9, the configuration of the projector 2 is the same as that of the projector 1 (refer to FIG. 2) of the first embodiment except for an imaging detection unit 50. Therefore, explanation excluding that of the imaging detection unit 50 will be omitted. Here, for the same components as in the first embodiment, the same reference numerals are used.

The imaging detection unit 50 is configured to include an imaging unit 51, an image analysis unit 52, and a position detection unit 53. The imaging detection unit 50 is controlled by the control unit 20. The imaging detection unit 50 detects the information of the position shift between the liquid crystal light valve for adjusting light and the liquid crystal light valve for display by imaging the projection surface SC and analyzing the image. In addition, the image analysis unit 52 and the position detection unit 53 correspond to a detection unit.

The imaging unit 51 includes an imaging device (not shown), such as a charge coupled device (CCD) sensor or a complementary metal oxide semiconductor (CMOS) sensor, and an imaging lens (not shown) for imaging the light emitted from an imaging target on the imaging device. The imaging unit 51 is disposed near the projection lens 19 of the projector 2, and images a range including an image projected onto the projection surface SC (hereinafter, also referred to as a "projected image") according to the instruction from the control unit 20. Then, the imaging unit 51 generates image information indicating a captured image, and outputs the image information to the image analysis unit 52.

The image analysis unit 52 is configured to include a processing device for image analysis and a memory (neither of which is shown). The image analysis unit 52 analyzes the image information of the captured image that is input from the imaging unit 51. The image analysis unit 52 outputs the analysis result to the position detection unit 53. In addition, the image analysis unit 52 converts the position information of the captured image into position information of an image displayed by the liquid crystal light valve for display.

Based on the analysis result of the image analysis unit 52, the position detection unit 53 detects a position corresponding to the liquid crystal light valve for adjusting light or the liquid crystal light valve for display in a projected image. The position detection unit 53 calculates position information indicating a position corresponding to the center of gravity of each light adjusting element of the liquid crystal light valve for adjusting light in the projected image, and detects the information of a position shift of the liquid crystal light valve for adjusting light with respect to the liquid crystal light valve for display based on the position information. Then, the detected position shift information is output to the shift information acquisition unit 45 and the control unit 20.

Figure 10:
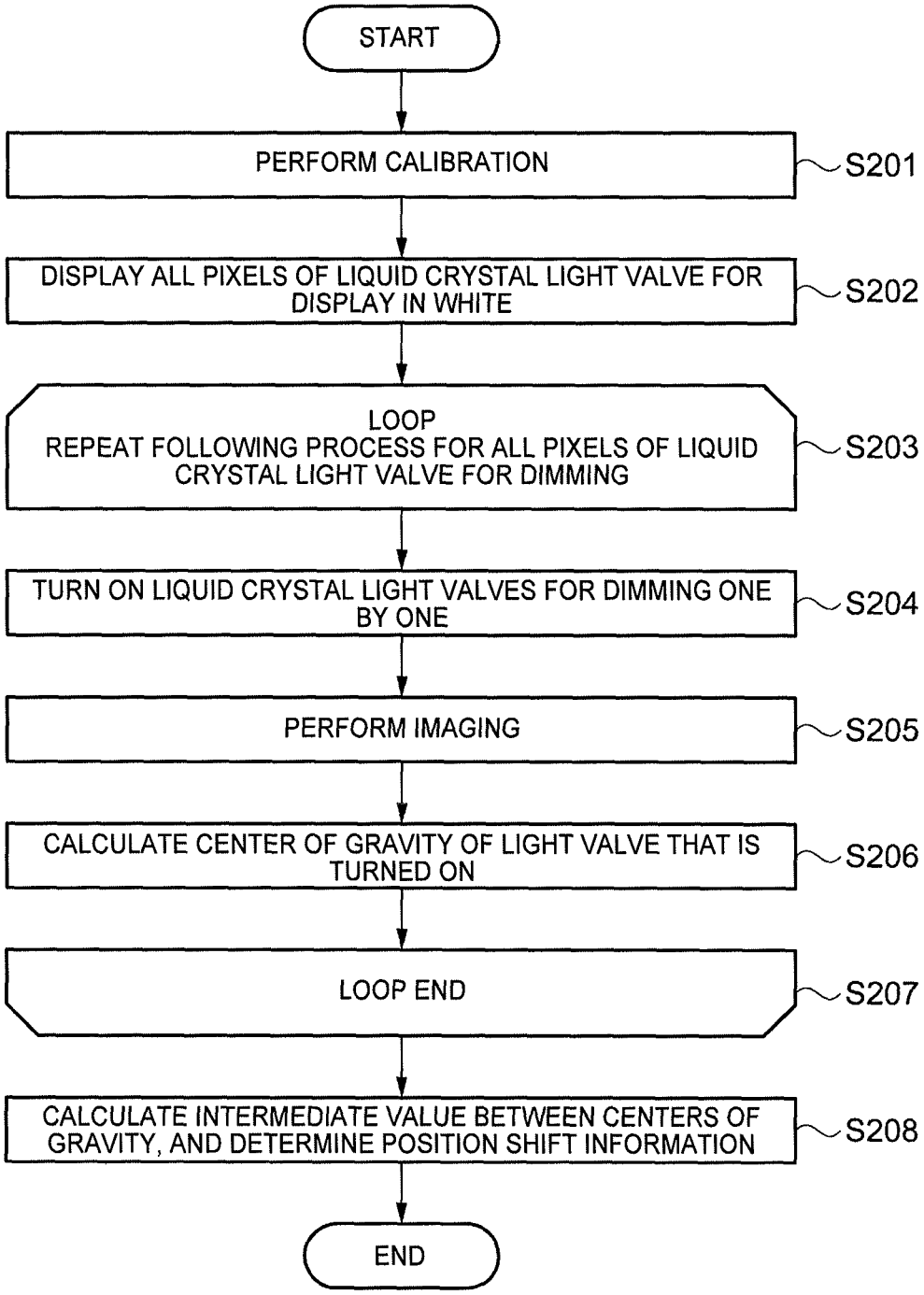
FIG. 10 is a flowchart of the process of detecting the position shift information of the projector according to the second embodiment.

Here, the process of detecting the position shift information will be described with reference to a flowchart. FIG. 10 is a flowchart of the process of detecting the position shift information of the projector 2 according to the second embodiment. The process of detecting the position shift information is performed when a predetermined instruction operation is performed by the operation receiving unit 21 provided in the projector 2. In addition, the timing at which the process of detecting the position shift information is performed is not limited to this. For example, the process of detecting the position shift information may be performed at the start of the projector 2.

When a predetermined operation is performed by the user, the projector 2 performs a calibration for associating a captured image with the coordinate position of the pixel of the liquid crystal light valve for display (step S201). Here, the calibration will be specifically described. First, according to the instruction from the control unit 20, the image processing unit 32 displays an image of the test pattern from the liquid crystal light valve for display in a state where all of the light adjusting pixels of the liquid crystal light valve for adjusting light are displayed in white. Examples of the test pattern include a pattern of dots arranged at equal intervals and a pattern of grid-like lines. According to the instruction from the control unit 20, the imaging unit 51 captures the test pattern. Then, the image analysis unit 52 and the position detection unit 53 calculate the relationship between the captured image and the pixel position of the liquid crystal light valve for display by analyzing the image. In this case, the control unit 20, the image processing unit 32, and the imaging detection unit 50 correspond to a calibration unit.

Then, according to the instruction from the control unit 20, the image processing unit 32 displays all of the display pixels of the liquid crystal light valve for display in white (step S202). Then, according to the instruction from the control unit 20, the image processing unit 32 repeats the process of steps S203 to S207 for each light adjusting pixel of the liquid crystal light valve for adjusting light (loop) (step S203).

First, the image processing unit 32 turns on the liquid crystal light valve for adjusting light by one pixel at a time (step S204). According to the instruction from the control unit 20, the imaging detection unit 50 captures a projected image (step S205). Based on the captured image, the imaging detection unit 50 calculates a position in the captured image corresponding to the center of gravity of the liquid crystal light valve for adjusting light that is turned on. Specifically, the center of gravity can be calculated by multiplying the brightness and the position of each pixel and taking the average value thereof. In this case, the control unit 20 and the imaging detection unit 50 correspond to a center-of-gravity specification unit. Then, the process returns to step S203 to repeat the process for the next light adjusting pixel (step S207).

The control unit 20 calculates an intermediate value between the calculated centers of gravity, and determines the position shift information (step S208). In this case, the control unit 20 corresponds to a position shift calculation unit. Then, the position shift information detection process ends.

Such a position shift information detection process is performed for each light valve of red light (LR), green light (LG), and blue light (LB). Thus, it is possible to detect the information of a position shift of the liquid crystal light valve for adjusting red light 17R2 with respect to the liquid crystal light valve for red light display 17R1, the information of a position shift of the liquid crystal light valve for adjusting green light 17G2 with respect to the liquid crystal light valve for green light display 17G1, and the information of a position shift of the liquid crystal light valve for adjusting blue light 17B2 with respect to the liquid crystal light valve for blue light display 17B1.

Here, the measurement of the position shift information of the light adjusting pixel P2(2, 3) of the liquid crystal light valve for adjusting light will be described as a specific example.

First, the calibration of the imaging unit 51 is performed.

A region surrounded by the pixel (A1, B1, C1, D1) of the liquid crystal light valve for display corresponding to the light adjusting pixel P2(2, 3) of the liquid crystal light valve for adjusting light is turned on, and the center of gravity (WX_CAM_A(2, 3), WY_CAM_A(2, 3)) of the coordinates of the captured image is calculated (all of the pixels of the liquid crystal light valve for adjusting light are displayed in white).

A pixel of the liquid crystal light valve for display corresponding to the light adjusting pixel P2(2, 4) adjacent to the right side of the light adjusting pixel P2(2, 3) of the liquid crystal light valve for adjusting light (region surrounded by the dotted line that is adjacent to the right side of the region surrounded by A1, B1, C1, and D1) is turned on, and the center of gravity (WX_CAM_A(2, 4), WY_CAM_A(2, 4)) of the coordinates of the captured image is calculated (all of the pixels of the liquid crystal light valve for adjusting light are displayed in white).

A pixel of the liquid crystal light valve for display corresponding to the light adjusting pixel P2(3, 3) immediately below the light adjusting pixel P2(2, 3) of the liquid crystal light valve for adjusting light (region surrounded by the dotted line that is located immediately below the region surrounded by A1, B1, C1, and D1) is turned on, and the center of gravity (WX_CAM_A(3, 3), WY_CAM_A(3, 3)) of the coordinates of the captured image is calculated (all of the pixels of the liquid crystal light valve for adjusting light are displayed in white).

Next, the center of gravity of the light adjusting pixel P2(2, 3) of the liquid crystal light valve for adjusting light is captured.

The light adjusting pixel P2(2, 3) of the liquid crystal light valve for adjusting light is turned on, and the center of gravity (WX_CAM_P(2, 3), WY_CAM_P(2, 3)) of the coordinates of the captured image is calculated (all pixels of the liquid crystal light valve for display are displayed in white).

Next, a position shift is calculated.

The calculation of position shift information (Dx, Dy) will be described using the following Expressions (6) and (7).

$$Dx=(WX_CAM_P(2, 3)-WX_CAM_A(2, 3))/\{(WX_CAM_A(2, 4)-WX_CAM_A(2, 3))/\text{horizontal pixel number of region } A1B1C1D1)\} \quad (6)$$

Here, {(WX_CAM_A(2, 4)−WX_CAM_A(2, 3)) /horizontal pixel number of region A1B1C1D1)} is the number of pixels in a camera (X direction) corresponding to one pixel of the projector 2.

$$Dy=(WY_CAM_P(2, 3)-WY_CAM_A(2, 3))/\{(WY_CAM_A(3, 3)-WY_CAM_A(2, 3))/\text{(vertical pixel number of region } A1B1C1D1)\} \quad (7)$$

Here, {WY_CAM_A(3, 3)−WY_CAM_A(2, 3))/(vertical pixel number of region A1B1C1D1)} is the number of pixels in a camera (Y direction) corresponding to one pixel of the projector 2.

The position shift measurement may be performed for one representative point of the light adjusting pixels, or may be performed for all of the pixels of the liquid crystal light valve for adjusting light. When measuring a position shift for all of the pixels of the liquid crystal light valve for adjusting light, an average value in each of the X and Y directions is calculated and is set as the total shift.

When measuring a position shift for all light adjusting pixels, light adjusting pixels located on the right end and the bottom end do not have regions adjacent to the right side and the bottom side thereof, respectively, in a calibration. In this case, regions adjacent to the left side and the top side are used.

The position shift information calculated as described above is output to the shift information acquisition unit 45 and the control unit 20, and is stored. Then, based on the position shift information, the light valve control unit 40 of the projector 2 performs light valve control processing corresponding to the position shift. The light valve control processing corresponding to the position shift is the same as that in the first embodiment. In addition, the shift information acquisition unit 45 may receive the position shift information from the position detection unit 53, and may receive the position shift information from the control unit 20.

According to the second embodiment described above, the same effects as the effects (1), (2), (3), and (4) of the first embodiment can also be obtained. Other effects are obtained as follows.

(1) The imaging detection unit 50 and the control unit 20 of the projector 2 calculate the position shift information based on the captured image that is captured by the imaging unit 51. The shift information acquisition unit 45 acquires the position shift information from the position detection unit 53. Therefore, the projector 2 can detect the position shift information using the imaging unit 51. As a result, even when a position shift occurs in the liquid crystal light valve for adjusting light and the liquid crystal light valve for display, it is possible to reproduce the gradation correctly, thus it is advantageous.

In addition, the invention is not limited to the embodiments described above, and various changes, improvements, and the like can be additionally made thereto. Modification examples will be described below.

MODIFICATION EXAMPLE 1

In the projectors 1 and 2, as the position shift information, position shift information for each of RGB may be input (acquired) as in the embodiments described above, or only position shift information for a certain color (for example, G) may be input and this position shift information may be used for other colors (for example, R and B). Thus, when only the manual input is given as in the projector 1 of the first embodiment, it is sufficient to input only the position shift information for one color. Accordingly, it is possible to reduce the labor of the user. In addition, also when the position shift information is automatically acquired using the imaging unit 51 as in the projector 2 of the second embodiment, it is sufficient to perform a calibration of one color. Accordingly, it is possible to reduce the calibration time.

MODIFICATION EXAMPLE 2

In the embodiments described above, in the projectors 1 and 2, a plurality of (three of RGB) light valves for display are used. However, one light valve for display (for example, a digital micromirror device (DMD)) may be used. In this case, since one light valve for adjusting light is used, it is sufficient to use position shift information for only one color. That is, it is not necessary to have position shift information for each of RGB.

MODIFICATION EXAMPLE 3

Although the feature quantity used in the light adjusting information determination unit 42 is set to the maximum value of the first image information in the embodiments described above, the feature quantity used in the light adjusting information determination unit 42 does not necessarily need to be the maximum value. For example, a bright pixel may be included in a dark screen region as noise. In such a case, if the feature quantity is set to the maximum value, black may stand out. For this reason, the feature quantity does not necessarily need to be the maximum value. For example, the feature quantity may be set to 90% of the pixel value of the maximum value, or may be set to an average value. In addition, the feature quantity may be set to a certain pixel value subsequent to the maximum value. For example, the feature quantity may be set to the third pixel value from the maximum value. In addition, it is also possible to include a histogram detection unit (not shown) that extracts a histogram (frequency-of-occurrence distribution) of each color of the red light LR, the green light LG, and the blue light LB from the first image information (video signal), so that the feature quantity is determined based on the frequency distribution.

MODIFICATION EXAMPLE 4

The projector 1 may include a noise reduction circuit (not shown). By removing the noise by performing a noise reduction process on the first image information input to the light valve control unit 40, the feature quantity used in the light adjusting information determination unit 42 may be set to the maximum value of the first image information.

MODIFICATION EXAMPLE 5

Figure 11:
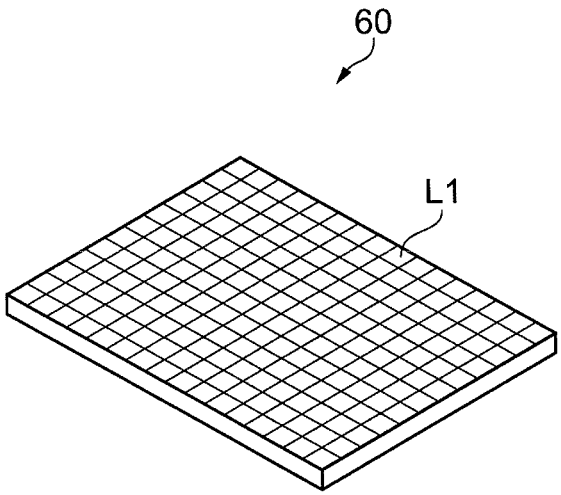
FIG. 11 is a perspective view of an LED array.

In the embodiments described above, the lighting unit has a configuration including the light source device 11 and the liquid crystal light valve for adjusting light. However, the lighting unit may be integrally configured as a light emitting diode (LED) array, for example. That is, the lighting unit may be an LED array. FIG. 11 is a perspective view of an LED array. As shown in FIG. 11, an LED array 60 is formed by arraying a plurality of light emitting portions (LEDs) L1 in a matrix. The LED array 60 may be provided instead of the liquid crystal light valves for adjusting light 17R2, 17G2, and 17B2 in the projector 1. In addition, when the image display device is a flat panel display (FPD) or the like, the LED array 60 may be provided as a lighting unit on the back side of the liquid crystal panel or the like in the FPD. In this case, each of the plurality of light emitting portions L1 included in the LED array 60 corresponds to a light adjusting element.

MODIFICATION EXAMPLE 6

In the embodiments described above, the liquid crystal light valve for adjusting light and the liquid crystal light valve for display are provided with a predetermined distance therebetween. However, distances between the liquid crystal light valve for adjusting light and the liquid crystal light valve for display for red light, green light, and blue light do not need to be the same. In addition, an optical element (relay lens) or the like may be provided between the liquid crystal light valve for adjusting light and the liquid crystal light valve for display.

MODIFICATION EXAMPLE 7

In the embodiments described above, the illumination range SA and the illumination intensity S (intensity distribution) are stored in the illumination distribution storage unit 41 in advance. However, the illumination range SA and the illumination intensity S may be configured to be writable or rewritable by the control unit 20. For example, based on the position shift information, information stored in the illumination distribution storage unit 41 may be rewritten to the illumination range SA and the illumination intensity S according to the position shift. In this case, the light valve control unit 40 can perform light valve control processing without taking position shift information into consideration. In addition, each of the projectors 1 and 2 may include a communication unit (not shown) that receives the information of the illumination range SA and the illumination intensity S from a device outside the projectors 1 and 2, and the information stored in the illumination distribution storage unit 41 may be rewritten by the control unit 20.

MODIFICATION EXAMPLE 8

In the embodiments described above, in the illumination distribution storage unit 41, the information of the illumination range SA and the intensity distribution is stored for each of the color light components or for only one color light component. However, a plurality of pieces of information of the illumination range SA and the intensity distribution may be stored in the illumination distribution storage unit 41 so as to be switchable according to the position of the light adjusting pixel of the liquid crystal light valve for adjusting light.

MODIFICATION EXAMPLE 9

In the embodiments described above, a user inputs the position shift information through the operation receiving unit 21, or the position shift information is detected by the imaging detection unit 50. However, each of the projectors 1 and 2 may include a communication unit (not shown) for receiving the position shift information from a device outside the projectors 1 and 2, and the position shift information may be input to the shift information acquisition unit 45 through the control unit 20.

MODIFICATION EXAMPLE 10

Although the projectors 1 and 2 have been mentioned as examples in the embodiments described above, the image display device is not limited to the projector. For example, the invention can also be applied to a rear projector, a liquid crystal display, a plasma display, an organic electroluminescence (EL) display, and the like that integrally include a transmissive screen.

MODIFICATION EXAMPLE 11

In the embodiments described above, the light source device 11 is configured to include a discharge type light source lamp 11*a*. However, it is also possible to use a solid-state light source, such as an LED light source or a laser, or other light sources.

MODIFICATION EXAMPLE 12

In the embodiments described above, each of the projectors 1 and 2 uses the transmissive liquid crystal light valves 17R1, 17G1, and 17B1 as a first light modulation device. However, it is also possible to use a reflective light modulation device, such as a reflective liquid crystal light valve. For example, a micromirror array device that modulates light emitted from the light source by controlling the emission direction of incident light for each micromirror as a pixel can also be used as a light modulation device. Similarly, although the transmissive liquid crystal light valves 17R2, 17G2, and 17B2 are used as a light modulation device included in the lighting unit, it is also possible to use a reflective light modulation device, such as a reflective liquid crystal light valve. For example, a micromirror array device that modulates light emitted from the light source by controlling the emission direction of incident light for each micromirror as a pixel can also be used as a light modulation device.

What is claimed is:

1. An image display device, comprising:

a light modulation device that includes a plurality of light valves, each of the light valves including a plurality of display pixels, the light modulation device being configured to modulate light based on first image information;

a lighting unit that includes a plurality of light adjusting elements, each of the light adjusting elements emitting adjusted light to a respective light valve of the plurality of light valves;

an illumination distribution storage unit that stores illumination range information, the illumination range information representing an illumination range when light emitted from the light adjusting elements illuminates the display pixels of the light valves;

a light adjusting information determination unit that determines light adjusting information for controlling the light adjusting elements of the lighting unit based on a feature quantity of the first image information corresponding to the display pixels in the illumination range; and a shift information acquisition unit that acquires information of a position shift between the light modulation device and the lighting unit, the position shift being a shift in an arrangement relationship between each light valve of the light modulation device and each respective light adjusting element of the lighting unit, wherein the light adjusting information determination unit modifies the illumination range based on the position shift information acquired by the shift information acquisition unit, and determines the light adjusting information based on a feature quantity of the first image information corresponding to display pixels in the modified illumination range.

2. The image display device according to claim 1, wherein the illumination distribution storage unit further stores distribution information of an illumination intensity when light emitted from the light adjusting elements illuminates the display pixels of the light modulation device, and the image display device further comprises:

an illumination value calculation unit, which calculates an illumination value of light reaching each of the display pixels of the light modulation device based on the light adjusting information of the lighting unit, the distribution information of the illumination intensity, and the position shift information; and an image information generation unit, which generates second image information to be set in the light modulation device based on the first image information and the illumination value of the light reaching each of the display pixels calculated by the illumination value calculation unit.

3. The image display device according to claim 2, wherein, in the image information generation unit, a value obtained by dividing a pixel value of the first image information by the illumination value is set as a pixel value of the second image information.

4. The image display device according to claim 1, wherein, in the light adjusting information determination unit, the feature quantity of the first image information is set to a maximum value of a pixel value of the first image information in an illumination range obtained by modifying the illumination range based on the position shift information.

5. The image display device according to claim 1, further comprising:

an operation receiving unit that receives an operation input for the image display device, wherein the operation receiving unit receives an input of the position shift information, and the shift information acquisition unit acquires the position shift information input by the operation receiving unit.

6. The image display device according to claim 1, further comprising:

an imaging unit that generates captured image data by imaging a range including an image displayed by the image display device; and a detection unit that detects the position shift information based on the captured image data that has been captured by the imaging unit, wherein the shift information acquisition unit acquires the position shift information from the detection unit.

7. The image display device according to claim 6, wherein the detection unit includes:

a calibration unit that associates positional relationship between the captured image data and a display image;

a center-of-gravity specification unit that specifies a position corresponding to a center of gravity of each light adjusting element in the display image by sequentially turning on the light adjusting elements of the lighting unit; and a position shift calculation unit that calculates the position shift information based on the center of gravity of each light adjusting element calculated by the center-of-gravity specification unit.

8. A control method of an image display device including a light modulation device that includes a plurality of light valves, each of the light valves including a plurality of display pixels, the light modulation device being configured to modulate light based on first image information, a lighting unit that includes a plurality of light adjusting elements, each of the light adjusting elements emitting adjusted light to a respective light valve of the plurality of light valves, and an illumination distribution storage unit that stores illumination range information, the illumination range information representing an illumination range when light emitted from the light adjusting elements illuminates the display pixels of the light valves, the control method comprising:

determining light adjusting information for controlling the light adjusting elements of the lighting unit based on a feature quantity of the first image information corresponding to the display pixels in the illumination range; and acquiring information of a position shift between the light modulation device and the lighting unit, the position shift being a shift in an arrangement relationship between each light valve of the light modulation device and each respective light adjusting element of the lighting unit, wherein, in the determination of the light adjusting information, the illumination range is modified based on the position shift information acquired in the acquisition of the position shift information, and the light adjusting information is determined based on a feature quantity of the first image information corresponding to display pixels in the modified illumination range.

9. The control method of an image display device according to claim 8, wherein the illumination distribution storage unit further stores distribution information of an illumination intensity when light emitted from the light adjusting elements illuminates the display pixels of the light modulation device, and the control method further includes calculating an illumination value of light reaching each of the display pixels of the light modulation device based on the light adjusting information of the lighting unit, the distribution information of the illumination intensity, and the position shift information, and generating second image information to be set in the light modulation device based on the first image information and the illumination value of the light reaching each of the display pixels calculated in the calculation of the illumination value.

* * * * *